US008869421B2

(12) United States Patent
Kim et al.

(10) Patent No.: US 8,869,421 B2
(45) Date of Patent: Oct. 28, 2014

(54) CONTROL TECHNOLOGY FOR CLOTHES TREATMENT APPARATUS

(75) Inventors: Donghyun Kim, Seoul (KR); Hyojin Ko, Seoul (KR); Sangik Lee, Seoul (KR); Jeongyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 675 days.

(21) Appl. No.: 13/100,541

(22) Filed: May 4, 2011

(65) Prior Publication Data

US 2011/0271550 A1 Nov. 10, 2011

(30) Foreign Application Priority Data

May 4, 2010 (KR) ..... 10-2010-0042000
May 7, 2010 (KR) ..... 10-2010-0042799
Jul. 19, 2010 (KR) ..... 10-2010-0069514
Jul. 22, 2010 (KR) ..... 10-2010-0070852
Sep. 2, 2010 (KR) ..... 10-2010-0085893

(51) Int. Cl.
*D06F 58/22* (2006.01)
*D06F 25/00* (2006.01)
*D06F 58/28* (2006.01)

(52) U.S. Cl.
CPC ..... *D06F 58/22* (2013.01); *D06F 25/00* (2013.01); *D06F 58/28* (2013.01); *D06F 2058/2864* (2013.01)
USPC ..... 34/381; 34/418; 34/424; 34/446; 68/18 R; 68/27; 8/149

(58) Field of Classification Search
USPC ..... 34/381, 413, 418, 427, 445, 446, 480, 34/497; 68/18 R, 19, 20; 8/149, 159
See application file for complete search history.

(56) References Cited

U.S. PATENT DOCUMENTS 2,809,025 A 10/1957 Pettyjohn
3,183,647 A 5/1965 Lang
4,082,524 A 4/1978 Noland
4,131,548 A 12/1978 Peterson
4,314,409 A 2/1982 Cartier et al.
4,439,218 A 3/1984 Priepke et al.
4,462,170 A 7/1984 Burkall et al.
4,700,492 A 10/1987 Werner et al.

(Continued)

FOREIGN PATENT DOCUMENTS

CN 2448866 Y 9/2001
CN 1773006 A 5/2006

(Continued)

OTHER PUBLICATIONS

Russian Office Action dated Sep. 13, 2013 for Application No. 2012150276, with English Translation, 6 pages.

(Continued)

*Primary Examiner* — Steve M Gravini
(74) *Attorney, Agent, or Firm* — Fish & Richardson P.C.

(57) ABSTRACT

In a general aspect, an apparatus for treating clothes includes a filter unit and a substance removal unit. The filter unit is positioned to filter substances from air discharged from an accommodating space and the substance removal unit is configured to move substances remaining on a portion of the filter unit. A method for controlling the apparatus for treating clothes includes detecting a condition related to the apparatus for treating clothes. The method further includes controlling, based on detection of the condition and without user input after detection of the condition, the substance removal unit to start removing substances remaining on the portion of the filter unit.

32 Claims, 12 Drawing Sheets

(56) References Cited

U.S. PATENT DOCUMENTS

| | | | |
|---|---|---|---|
| 4,831,678 | A | 5/1989 | Dietsche |
| 4,848,105 | A | 7/1989 | O Connell et al. |
| 5,006,136 | A | 4/1991 | Wetter |
| 5,210,960 | A | 5/1993 | LaRue |
| 5,217,512 | A | 6/1993 | Williams |
| 5,463,820 | A | 11/1995 | La |
| 5,497,563 | A | 3/1996 | Mayfield |
| 5,701,684 | A | 12/1997 | Johnson |
| 6,974,487 | B2 | 12/2005 | Twiefel |
| 7,305,775 | B2 | 12/2007 | Favret et al. |
| 7,681,420 | B2 | 3/2010 | Jeong et al. |
| 7,802,375 | B2 | 9/2010 | Johnson |
| 8,028,439 | B2 | 10/2011 | Prajescu |
| 8,048,205 | B2 | 11/2011 | Schaub |
| 8,097,050 | B2 | 1/2012 | Johnson et al. |
| 8,109,011 | B2 | 2/2012 | Prajescu |
| 8,156,659 | B2 | 4/2012 | Jung et al. |
| 8,240,064 | B2 | 8/2012 | Steffens |
| 8,375,597 | B2 | 2/2013 | Ahn et al. |
| 8,381,412 | B2 | 2/2013 | Ahn et al. |
| 2006/0075577 | A1 | 4/2006 | Jeong et al. |
| 2006/0201014 | A1 | 9/2006 | Favret et al. |
| 2007/0107250 | A1 | 5/2007 | Gassmann et al. |
| 2007/0144028 | A1 | 6/2007 | Audet et al. |
| 2008/0196268 | A1 | 8/2008 | Jung et al. |
| 2010/0146804 | A1 | 6/2010 | Ahn et al. |
| 2010/0154241 | A1 | 6/2010 | Ahn et al. |
| 2010/0192768 | A1 | 8/2010 | Kim et al. |
| 2011/0154587 | A1 | 6/2011 | Kim |
| 2011/0154675 | A1 | 6/2011 | Pillot et al. |
| 2011/0173834 | A1 | 7/2011 | Arrigoni et al. |
| 2011/0225837 | A1 | 9/2011 | Ahn et al. |
| 2011/0225838 | A1 | 9/2011 | Ahn et al. |
| 2011/0258872 | A1 | 10/2011 | Kim et al. |
| 2011/0271543 | A1 | 11/2011 | Kim et al. |
| 2011/0271550 | A1 | 11/2011 | Kim et al. |
| 2012/0084992 | A1 | 4/2012 | Shin et al. |
| 2012/0090189 | A1 | 4/2012 | Kwon et al. |
| 2012/0102777 | A1 | 5/2012 | Dendel |
| 2012/0144687 | A1 | 6/2012 | Yeom |
| 2012/0180534 | A1 | 7/2012 | Cho et al. |

FOREIGN PATENT DOCUMENTS

| | | | |
|---|---|---|---|
| EP | 1 719 833 | B1 | 3/2008 |
| EP | 2145999 | A1 | 1/2010 |
| EP | 2146000 | A1 | 1/2010 |
| JP | 06-098993 | A | 4/1994 |
| JP | 08-280996 | A | 10/1996 |
| JP | 2008-006045 | A | 1/2008 |
| JP | 2010-0155032 | A | 7/2010 |
| KR | 10-0140017 | B1 | 7/1998 |
| KR | 10-2004-0006233 | A | 1/2004 |
| KR | 10-2004-0011216 | A | 2/2004 |
| KR | 10-0651856 | B1 | 11/2006 |
| KR | 10-2009-002564 | A | 3/2009 |
| KR | 10-09002564 | A | 6/2009 |
| KR | 10-2009-0102415 | A | 9/2009 |
| KR | 10-2010-0070019 | A | 6/2010 |
| WO | WO 2009/015919 | A1 | 2/2009 |
| WO | WO 2010/071355 | A2 | 6/2010 |

OTHER PUBLICATIONS

PCT International Search Report and Written Opinion dated Apr. 20, 2012 for Application No. PCT/KR2011/003348, 11 pages.

Korean Notice of Allowance dated Aug. 29, 2012 for Application No. 10-2010-0042799, with English Translation, 3 pages.

U.S. Office Action dated Aug. 29, 2013 for U.S. Appl. No. 13/102,080, 16 pages.

PCT International Search Report and Written Opinion dated May 14, 2012 for Application No. PCT/KR2011/003339, 11 pages.

U.S. Office Action dated Mar. 22, 2013 for U.S. Appl. No. 13/102,080, 21 pages.

Taiwan Office Action dated Dec. 6, 2013 for Application No. dated Dec. 6, 2013, in English, 22 pages.

Chinese Office Action dated Aug. 5, 2014 for Chinese Application No. 201180022482.5, with English Translation, 20 pages.

Chinese Office Action dated Aug. 18, 2014. Chinese Application No. 201180022955.1, with English Translation, 24 pages.

| Category \ Level | 1 | 2 | 3 | Weight Dimensionless Number |
|---|---|---|---|---|
| Clothes Quantity (A) | A1 Level | A2 Level | A3 Level | w |
| | 10sec | 20sec | 30sec | |
| Clothes Type (B) | B1 Level | B2 Level | B3 Level | x |
| | 10sec | 30sec | 50sec | |
| Target Dryness (C) | C1 Level | C2 Level | C3 Level | y |
| | 10sec | 15sec | 20sec | |
| Target Drying Time (D) | D1 Level | D2 Level | D3 Level | z |
| | 5sec | 10sec | 15sec | |

*In case of A2, B1, C3, D1,
T (Cleaning Time Performance Time) = 20w + 10x + 20y + 5z

CONTROL TECHNOLOGY FOR CLOTHES TREATMENT APPARATUS

CROSS REFERENCE TO RELATED APPLICATIONS

Pursuant to 35 U.S.C. §119(a), this application claims the benefit of the Korean Patent Application No. 10-2010-0042799 filed on May 7, 2010, the Korean Patent Application No. 10-2010-0042000 filed on May 4, 2010, the Korean Patent Application No. 10-2010-0070852 filed on Jul. 22, 2010, the Korean Patent Application No. 10-2010-0069514 filed on Jul. 19, 2010 and the Korean Patent Application No. 10-2010-0085893 filed on Sep. 2, 2010, all of which are incorporated herein by reference in their entirety.

TECHNICAL FIELD

The following disclosure relates generally to control of a clothes treatment apparatus.

BACKGROUND

In general, clothes treatment apparatus are electric appliances used to perform washing, drying or both washing and drying of clothes. Clothes treatment apparatus include washing machines, dryers and machines having both washing and drying functions. In a conventional clothes treating apparatus capable of drying clothes, removal of foreign substances, such as lint, from the discharged air may be desirable.

BRIEF DESCRIPTION OF THE FIGURES

FIG. 13 illustrates a cleaning time and a weight table which are preset based on a quantity of clothes, a type of clothes, a target dryness and a target drying time.

SUMMARY

Figure 1:
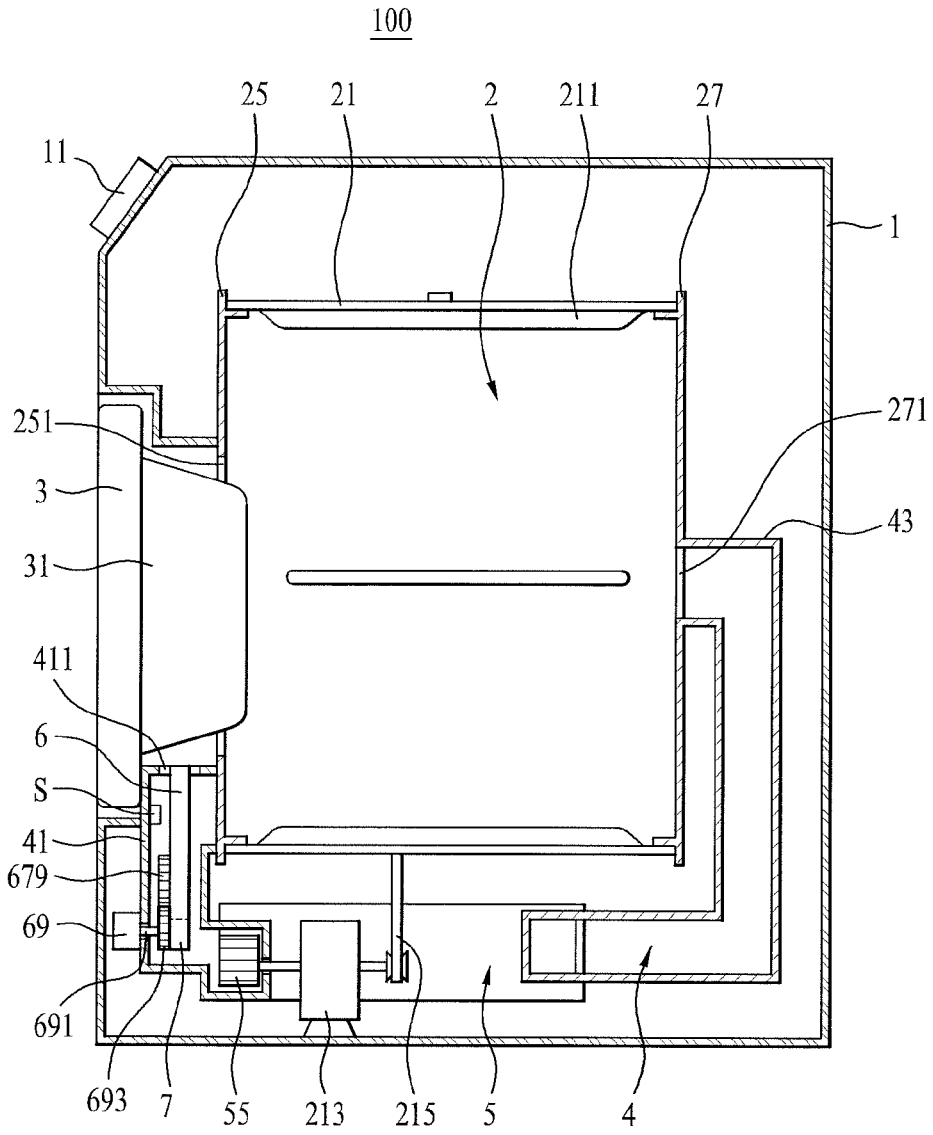
FIG. 1 is a schematic illustration of a clothes treatment apparatus.

Accordingly, the present invention is directed to a control method for a clothes treatment apparatus.

An object of the present invention is to provide a control method for a clothes treatment apparatus including a filter unit configured to filter foreign substances from air exhausted from an accommodating space for receiving clothes therein, and a foreign substance removal unit configured to clean the filter assembly.

Another object of the present invention is to provide a control method for a clothes treatment apparatus including the filter unit which does not have to be cleaned every time when the clothes treatment apparatus is used.

A further object of the present invention is to provide a control method for a clothes treatment apparatus which can control a cleaning timing of the filter unit based on a drying condition.

A still further object of the present invention is to provide a control method for a clothes treatment apparatus which can control a time period of cleaning the filter unit based on the amount of clothes received in the accommodating space, a type of clothes, a target dryness and a drying time period.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for controlling an apparatus for treating clothes that includes an accommodating space having clothes accommodated therein, an air supply unit configured to supply air to the accommodating space, a filter unit configured to filter foreign substances from air exhausted from the accommodating space and a foreign substance removal unit configured to remove the foreign substances remaining in the filter unit, the method includes a cycle starting step configured to start a drying cycle supplying air to the accommodating space by controlling the air supply unit; a filter unit cleaning step removing the foreign substances remaining in the filter unit by controlling the foreign substance removal unit to remove.

The method may further include a finishing time point determining step determining a finishing time point of the drying cycle. The filter unit cleaning step may be started at a time point located prior to a preset time period from the finishing time point of the drying cycle.

The filter unit cleaning step may start at a preset time point located after a preset time period from a starting time point of the drying cycle.

The method may further include a determining step determining whether a drying cycle performed before the cycle starting step finishes without performing the filter unit cleaning step; and a filter unit first cleaning step removing the foreign substances remaining the filter unit, before the cycle starting step, when the drying cycle performed before the cycle starting step finishes without performing the filter unit cleaning step.

The method may further include a determining step determining dryness of the clothes accommodated in the accommodating space by controlling dryness measuring means provided in the clothes treatment apparatus. The filter unit cleaning step is started when the measured dryness may be a preset reference dryness level or higher.

The method may further include a clothes quantity determining step determining the quantity of the clothes accommodated in the accommodating space by controlling clothes quantity sensing means provided in the clothes treatment apparatus, the clothes quantity determining step provided before the filter unit cleaning step; and a time period setting step setting a performance time period of the filter unit cleaning step in proportion to the measured quantity of the clothes. The filter unit cleaning step may be performed for the set performance time period.

The method may further include a drying condition determining step determining a drying condition set in the drying cycle, the drying condition determining step provided before the filter unit cleaning step; and a time period setting step setting a performance time period of the filter unit cleaning step based on the determined drying condition. The filter unit cleaning step may be performed for the set performance time period.

The method may further include a data setting step setting at least two data of the quantity of the clothes accommodated in the accommodating space, a type of the clothes accommodated in the accommodating space, a target dryness set in the drying cycle and a target drying time period set in the drying cycle, the data setting step provided before the filter unit cleaning step; and a time period setting step setting a performance time period of the filter unit cleaning step as the sum of values gained from multiplying each of the filter unit cleaning times set based on the quantity of the clothes, the type of the clothes, the target dryness and the target drying time period by each of weights set based on the quantity of the clothes, the type of the clothes, the target dryness and the target drying time period. The filter unit cleaning step may be performed for the set performance time period.

The method may further include a mode selecting step selecting a manual-mode and an auto-mode. The cycle starting step and the filter unit cleaning step are performed sequentially, when the auto-mode is selected. Only the filter unit cleaning step is performed when the manual-mode is selected.

The method may control the clothes treatment apparatus including the filter unit configured to filter foreign substances from air exhausted from the accommodating space and a foreign substance removal unit configured to clean the filter unit.

Furthermore, according to the method, the filter unit does not have to be cleaned every time when the clothes treatment apparatus is put into operation.

A still further, a cleaning point of the filter unit may be controlled based on drying conditions effectively.

A still further, a cleaning time period of the filter unit may be controlled based on the quantity of clothes accommodated in the accommodating space, a type of the clothes, a target dryness and a target drying time period.

An apparatus for treating clothes includes a filter unit and a substance removal unit. The filter unit is positioned to filter substances from air discharged from an accommodating space and the substance removal unit is configured to move substances remaining on a portion of the filter unit.

A method for controlling the apparatus for treating clothes includes detecting a condition related to the apparatus for treating clothes. The method further includes controlling, based on detection of the condition and without user input after detection of the condition, the substance removal unit to start removing substances remaining on the portion of the filter unit.

Particular implementations may include one or more of the following. Detecting the condition related to the apparatus for treating clothes comprises detecting a timing condition related to the apparatus for treating clothes. Controlling the substance removal unit to start removing substances remaining on the portion of the filter unit, without user input after detection of the condition, includes controlling, without user input after detection of the timing condition, the substance removal unit to start removing substances remaining on the portion of the filter unit.

Detecting the timing condition related to the apparatus for treating clothes includes determining an ending time of a drying cycle being performed by the apparatus for treating clothes, and determining that a present time is a predetermined time prior to the ending time of the drying cycle being performed by the apparatus for treating clothes. Controlling the substance removal unit to start removing substances remaining on the portion of the filter unit, without user input after detection of the timing condition, includes controlling the substance removal unit to start removing substances remaining on the portion of the filter unit based on determining that the present time is the predetermined time prior to the ending time of the drying cycle being performed by the apparatus for treating clothes.

Detecting the timing condition related to the apparatus for treating clothes further includes determining a starting time of a drying cycle being performed by the apparatus for treating clothes, and determining that a present time is a predetermined time after the starting time of the drying cycle being performed by the apparatus for treating clothes. Furthermore, controlling the substance removal unit to start removing substances remaining on the portion of the filter unit, without user input after detection of the timing condition, includes controlling the substance removal unit to start removing substances remaining on the portion of the filter unit based on determining that the present time is the predetermined time after the starting time of the drying cycle being performed by the apparatus for treating clothes.

Detecting the timing condition related to the apparatus for treating clothes also includes determining a starting time and an ending time of a drying cycle being performed by the apparatus for treating clothes, and determining that a second time is a predetermined time prior to the ending time of the drying cycle being performed by the apparatus for treating clothes. Moreover, controlling the substance removal unit to start removing substances remaining on the portion of the filter unit, without user input after detection of the timing condition, includes controlling, at the first time, the substance removal unit to start removing substances remaining on the portion of the filter unit based on determining that the first time is the predetermined time after the starting time of the drying cycle being performed by the apparatus for treating clothes, and controlling, at the second time, the substance removal unit to start removing substances remaining on the portion of the filter unit based on determining that the second time is the predetermined time prior to the ending time of the drying cycle being performed by the apparatus for treating clothes.

Detecting the timing condition related to the apparatus for treating clothes includes, in addition, determining a scheduled time to start removing substances remaining on the portion of the filter unit. Subsequently, on determining that a present time is the scheduled time to start removing substances remaining on the portion of the filter unit, the substance removal unit is controlled, without user input after detection of the timing condition, to start removing substances remaining on the portion of the filter unit.

Detecting the condition related to the apparatus for treating clothes includes detecting a dryer condition related to the apparatus for treating clothes and further, after detection of the dryer condition, the substance removal unit is controlled, without user input, to start removing substances remaining on the portion of the filter unit.

Detecting the dryer condition related to the apparatus for treating clothes includes detecting an end of a drying cycle being performed by the apparatus for treating clothes and thereupon controlling the substance removal unit, without user input and based on detecting the end of the drying cycle, to start removing substances remaining on the portion of the filter unit.

Detecting a dryer condition related to the apparatus for treating clothes further includes determining, during a drying cycle being performed by the apparatus for treating clothes, a measure of dryness for clothes being dried by the apparatus. Based on determining that the measure of dryness for clothes being dried by the apparatus meets a reference dryness, the substance removal unit is controlled, without user input after detection of the timing condition, to start removing substances remaining on the portion of the filter unit.

Detecting a condition related to the apparatus for treating clothes includes detecting a filter condition related to the apparatus for treating clothes. Upon detection of the filter condition, the substance removal unit is controlled, without user input, to start removing substances remaining on the portion of the filter unit.

Detecting the filter condition related to the apparatus for treating clothes includes sensing an amount of substances positioned on the filter unit. Based upon determining that the amount of substances positioned on the filter unit meets a reference value, the substance removal unit is controlled, without user input, to start removing substances remaining on the portion of the filter unit.

DETAILED DESCRIPTION

Clothes treating apparatus capable of drying clothes are classified into two categories based on air flow methods to supply air at a high temperature (e.g., hot air) to clothes: an exhaust type clothes treating apparatus and a circulation type (e.g., condensation type) clothes treating apparatus.

In the circulation type clothes treatment apparatus, air in an accommodating space having clothes received therein is circulated and moisture is removed (e.g., dehumidified) from air exhausted from the accommodating space and the dehumidified air is then heated. The heated air is re-supplied to the accommodating space.

In the exhaust type clothes treatment apparatus, heated air is supplied to the accommodating space and the air discharged from the accommodating space is discharged to the outside of the clothes treating apparatus without being recirculated.

It may be desirable to remove foreign substances such as lint from the air exhausted from the accommodating space provided in a conventional clothes treatment apparatus having a drying function. In case of the circulation type clothes treating apparatus, after dehumidifying the air exhausted from the accommodating space, the circulation type clothes treatment apparatus heats the air by using a heat exchanging device and it re-supplies the heated air to the accommodating space. If foreign substances are not removed before the air is heated, the foreign substances may accumulate in the heat exchanging device. Therefore, the heat exchange efficiency of the clothes treatment apparatus may be lowered.

In case of the exhaust type clothes treating apparatus, if air is discharged from the accommodating space without being filtered, lint or dust contained in the discharged air may be supplied to an indoor space provided with the clothes treating apparatus.

Therefore, it may be beneficial to filter air discharged from an accommodating space of a clothes treating apparatus capable of drying clothes. A filter is hence provided in a clothes treatment apparatus to filter foreign substances from the air exhausted from the accommodating space. A mechanism may be provided in the clothes treatment apparatus that enables the filter to be cleaned automatically, thereby reducing the requirement for a user to check the state of the filter before or after the clothes treatment apparatus is used.

FIG. 1 illustrates an example clothes treatment apparatus which is an object of a control method according to the present disclosure. In reference to FIG. 1, a structure of the clothes treatment apparatus is described. The clothes treatment apparatus includes a filter assembly configured to filter foreign substances and a foreign substance removal unit configured to remove foreign substances remaining in the filter assembly.

A clothes treatment apparatus 100 according to the present disclosure includes a cabinet 1 configured to defining an exterior appearance thereof and an accommodating space 2 provided in the cabinet to accommodate clothes therein.

In case of a clothes treatment apparatus having only a drying function, the accommodating space 2 may be provided as a drum 21 configured to form a predetermined space capable of receiving drying objects therein. The drum may have a cylindrical shape with an open front and an open back.

A front supporting part 25 is provided in a front portion of the drum to support the open front and a rear supporting part 27 is provided in a rear portion of the drum to support the open back of the drum.

The front supporting part 25 has an opening 251 to load or unload the clothes into or out of the drum. The opening 251 is opened and closed by a door 3 rotatably coupled to the cabinet.

The door 3 may include a door glass 31 extended toward the opening 251. The door glass 31 may create an effect which allows a user to observe an inside of the drum while the clothes treatment apparatus is operated and another effect that the clothes moved to the door during the rotation of the drum can be guided toward the inside of the drum.

The rear supporting part 27 includes a supply hole 271 configured to enable passage of external air into the drum and the supply hole 271 is connected with a supply duct 43 which will be described later.

The drum 21 supported by both of the front supporting part and the rear supporting part may be rotated by a drum motor 213 and a belt 215. A lifter 211 may be provided in an inner circumferential surface of the drum 21 to agitate drying objects efficiently and smoothly.

The clothes treatment apparatus may further include a duct 4 and an air supply unit 5 to supply air (not heated air) or heated air to the clothes received in the drum.

The duct may be configured of a discharge duct 41 configured to exhaust internal air of the drum which is the accommodating space and a supply duct 43 configured to supply external air to the drum 21. The discharge duct 41 includes a suction hole 411 to enable passage of the air exhausted from the drum 21 and the supply duct 43 is connected with the supply hole 271 of the rear supporting part, in communication with the discharge duct. Because of that, air which has passed the air supply unit 5 may be supplied to the drum.

In case of the circulation type clothes treatment apparatus, the discharge duct 41 and the supply duct 43 may be connected with each other, only to form a single path. The air supply unit 5 may include a fan 55, a condensing part configured to dehumidify the air moving along the duct 4 and a heating part configured to heat the dehumidified air.

The fan 55 may be rotated by the drum motor 213, as an air circulation device configured to suck the internal air of the drum into the discharge duct 41.

Once the fan 55 is rotated, internal air of the duct 4 may be moving into the drum 21. When the internal air of the duct is drawn into the drum, internal air of the drum may be exhausted via the suction hole 411 to be drawn into the discharge duct 41.

The air drawn into the discharge duct may be moved toward the supply duct 43 via the air supply unit 5 and it may be then dehumidified and heated in this process, such that the clothes loaded into the drum 21 may be dried.

In the meanwhile, foreign substances such as lint may be generated while the clothes are dried in the circulation type clothes treatment apparatus and the foreign substances discharged from the clothes are circulated along the duct 4. Because of that, if the foreign substances are not filtered from the air exhausted from the drum, the foreign substances might be adhered to a surface of the heat exchanging device including the condensing part and the heating part. This might result in deteriorating drying efficiency of the clothes treatment apparatus.

As a result, the clothes treatment apparatus according to the present disclosure further includes a filter assembly 6 configured to filter foreign substances from the air circulating along the duct 4 not only to limit the drying efficiency from becoming poor, but also to limit a flow rate from becoming low due to the foreign substances.

The clothes treatment apparatus may further include a foreign substance compression part 7 configured to compress and store the foreign substances filtered by the filter assembly 6.

The filter assembly 6 may be detachably provided in the suction hole 411 of the discharge duct 41. In this case, the user may attach or detach the filter assembly 6 to or from the clothes treatment apparatus after opening the door 3.

Here, the foreign substance compression part 7 may be provided in the filter assembly 6 or it may be detachably provided with respect to the filter assembly 6.

Figure 2:
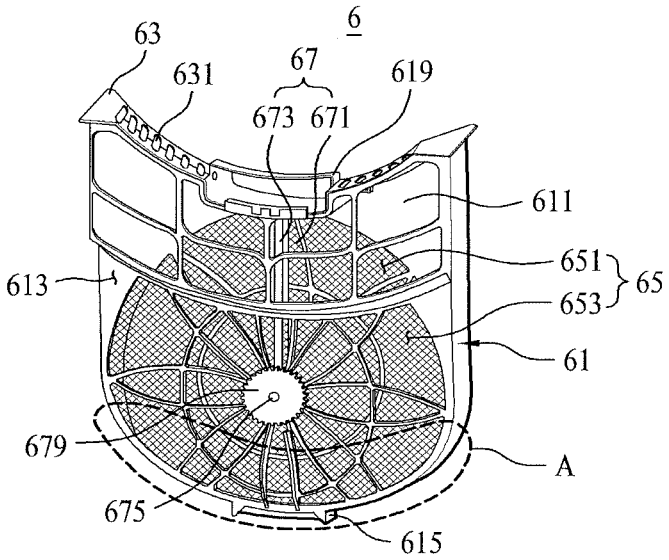
FIGS. 2A and 2B are perspective views illustrating a filter assembly provided in the clothes treatment apparatus.
Figure 2:
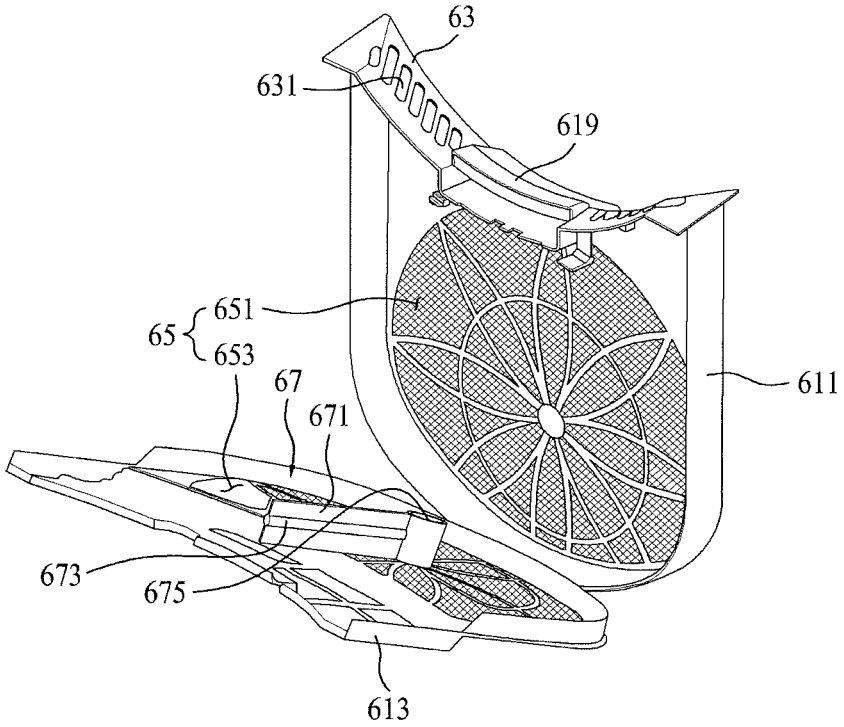

When the foreign substance compression part 7 is located in the filter assembly 6, the filter assembly 6 may have a structure shown in FIG. 2. When the foreign substance compression part is detachable from the filter assembly, the filter assembly may have a structure shown in FIG. 3.

Figure 4:
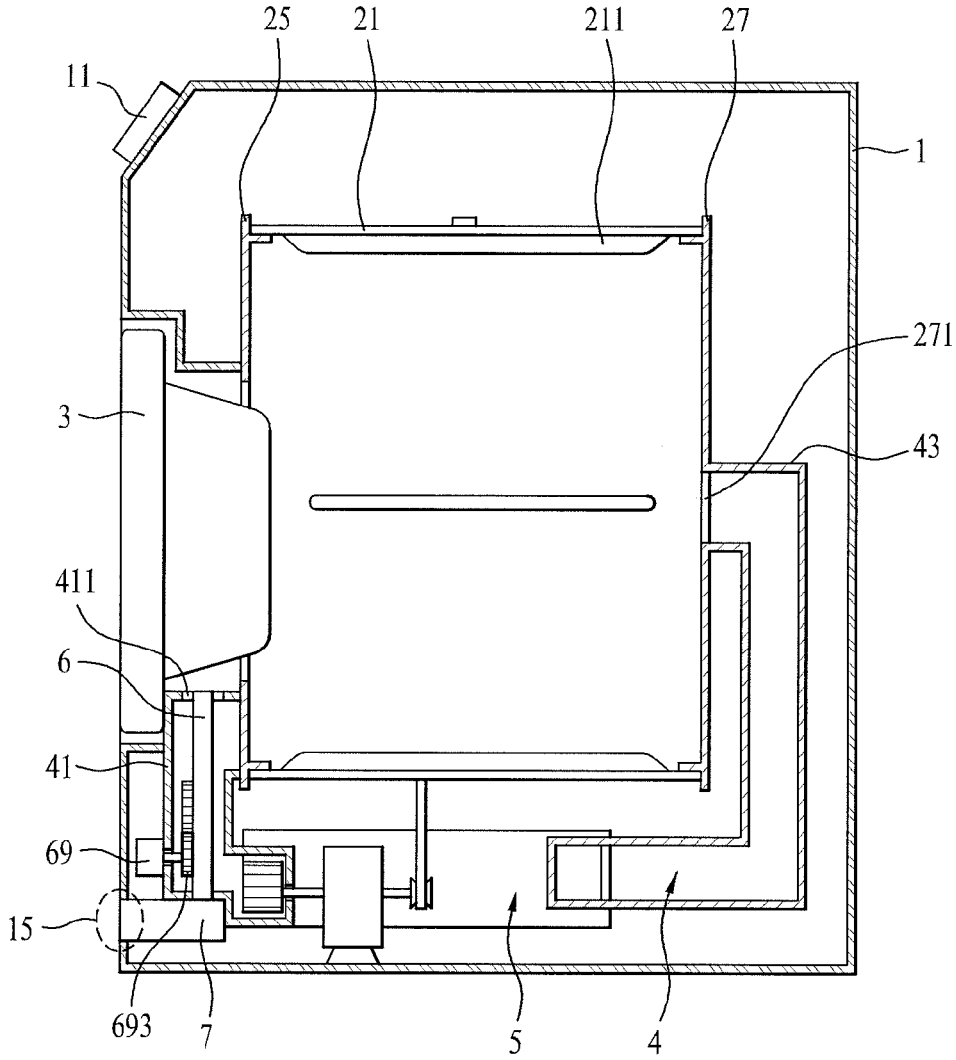
FIG. 4 illustrates another implementation of a clothes treatment apparatus.

By extension, when the foreign substance compression part is detachable from the filter assembly, the foreign substance compression part 7 and the filter assembly 6 may be located within the discharge duct 41 as shown in FIG. 1 or the foreign substance compression part may be separable via an entrance 15 provided in a front surface of the cabinet 1 as shown in FIG. 4.

In the latter case, the foreign substance compression part 7 may be provided outside the discharge duct 41, in communication with a lower portion of the filter assembly. In the former case, the user may open the door 3 and he or she may detach the filter assembly 7 from the discharge duct 41. After that, the user may separate the foreign substance compression part 7 from the filter assembly and the foreign substances stored in the foreign substance compression part may be removed.

This implementation presents the filter assembly and the foreign substance compression part described above are provided in the circulation type clothes treatment apparatus having the drying function. However, the filter assembly and the foreign substance compression part described above may be applicable to the clothes treatment apparatus having washing and drying functions or the exhaust type clothes treatment apparatus only having the drying function.

In other words, the filter assembly 6 and the foreign substance compression part 7 described above may be applied to the exhaust type clothes treatment apparatus (which is used to dry clothes).

The exhaust type clothes treatment apparatus heats external air and supplies the heated air to the accommodating space (e.g., drum 21), and the exhaust type clothes treatment apparatus exhausts air from the accommodating space 21 outside of the clothes treating apparatus.

As a result, in case of the exhaust type clothes treatment apparatus, the discharge duct 41 and the supply duct 43 are separated from each other. The air supply unit 5 is provided in the supply duct 43.

Figure 5:
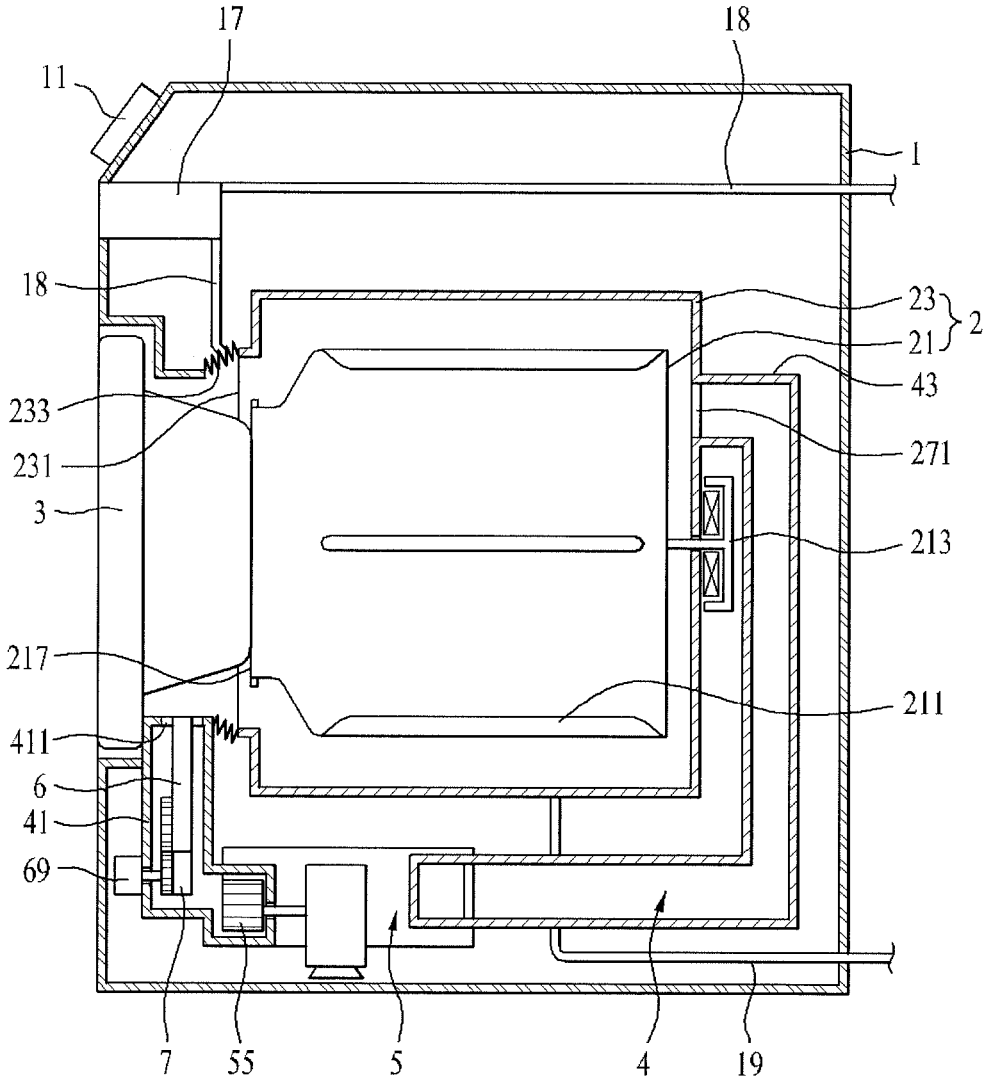
FIG. 5 illustrates a structure of a clothes treatment apparatus having drying and washing functions for cloths.

FIG. 5 illustrates the circulation type clothes treatment apparatus capable of washing and drying clothes.

A tub 23 is provided in the cabinet. The tub 23 may be configured to hold the drum 21 and wash water therein. Because of that, the accommodating space 2 is an element including the tub 23 and the drum 21.

A tub opening 231 is provided in the tub to load and unload the clothes into the accommodating space. A drum opening 217 is provided in the drum to communicate with the tub opening 231.

According to this structure, there may be further provided a supply hose 18 configured to supply wash water to the tub, and a drainage hose 19 configured to drain the wash water held in the tub. The supply hose 18 may be in communication with the tub via a detergent box 17.

The tub 23 and the cabinet 1 may be sealed with each other via a gasket 233. The discharge duct 41 may be in communication with a front surface of the tub 23 and the supply duct 43 may be in communication with a rear surface of the tub 23.

Here, the supply duct 43 could be located to supply air via the front surface of the tub, different from FIG. 5.

The filter assembly 6 is detachably provided in an suction hole 411 of the discharge duct 41.

The drum motor 213 configured to rotate the drum 21 may rotate the fan 55 and the drum 21 simultaneously as shown in FIG. 1, or it may rotate only the drum as shown in FIG. 5.

In the former case, a driving pulley may be provided in the drum motor and a driven pulley connected with the driving pulley via a belt may be provided in a rear surface of the tub. Here, the driven pulley is fixed to a rear surface of the drum via a shaft.

Although not shown in the drawings, the supply duct and the discharge duct are separated in the case of an exhaust type clothes treatment apparatus having washing and drying functions. Detailed description of the exhaust type clothes treatment apparatus will not be repeated.

As follows, the structure of the filter assembly 6 will be described in reference to FIG. 2.

The filter assembly 6 may include a housing 61 detachably provided in the suction hole 411 of the discharge duct, an inflow surface 63 provided in communication with the air inlet 411 to draw air into the housing 61, a filter unit 65 configured to filter foreign substances such as lint drawn into the housing, and a foreign substance removal unit 67 configured to move the foreign substances remaining in the filter unit toward the foreign substance compression part 7.

The housing 61 includes a first housing 611 and a second housing 613 which are detachable from each other. The first housing 611 and the second housing 613 attach to each other via a hinge 615. The inflow surface 63 may be provided on the first housing 611 or the second housing 613. FIG. 2 illustrates the inflow surface 63 provided on the first housing 611.

The shape of the inflow surface 63 may correspond to the shape of the suction hole 411 provided in the discharge duct and the inflow surface may include a plurality of inflow holes 631 to guide the air drawn via the suction hole 411 into the housing 61.

The housing 61 may further include a handle 619 configured to enable the discharge duct and the housing to be detached smoothly.

The filter unit 65 is configured to remove foreign substances from the air exhausted from the accommodating space and to supply the air to the duct 4 after that. The filter unit 65 may be provided in at least one surface of the housing 61.

For example, the filter unit 65 may be provided in a mesh shape to remove foreign substances from the air drawn into the housing 61 and to allow the air having the foreign substances to be removed therefrom to move along the duct 4.

In addition, the filter assembly 6 may be a pair of filters provided in both opposite ends of the inflow surface 63 to increase a filtering capacity (e.g., to maximize the quantity of air passing the filter assembly).

That is, the filter unit may be configured of a first filter 651 provided in the first housing 611 and a second filter 653 provided in the second housing 613.

The foreign substance removal unit 67 may be rotatably provided in the housing 61 to move the foreign substances remaining in the filter unit 65 toward a predetermined portion (e.g., a storage space, such as the foreign substance compression part 7) inside the housing to compress them.

For that, the foreign substance removal unit may include a brush 671 provided in contact with the filter unit 65, a brush frame 673 to fix the brush thereto, and a brush shaft 675 configured to transmit a power received from a brush motor (e.g., motor 69, see FIGS. 1, 4, and 5) to the brush frame 673.

The brush shaft 675 may be inserted in the brush frame 673, passing through the filter unit 65, and it may include a brush driven gear 679 located outside the housing.

The brush driven gear 679 may be rotated by engaging with a brush driving gear 693 (see FIGS. 1 and 4) provided in the brush motor 69. The brush motor 69 may be located outside the discharge duct 41 and that the brush driving gear 693 may be located inside the discharge duct 41 and engage with a shaft 691 (see FIG. 1) of the brush motor.

As a result, when the user inserts the filter assembly 6 to the suction hole 411 of the discharge duct 41, the brush driving gear and the brush driven gear may engage.

FIG. 1 presents the power transmission structure including only the brush driving gear and the brush driven gear. A connection gear for connecting the brush driving gear and the brush driven gear with each other may be further provided in the discharge duct 41.

The connection gear may be used because the rotational force has to be transmitted to the foreign substance removal unit if the brush motor is located to make it difficult to connect the brush driving gear and the brush driven gear with each other directly.

In addition, FIG. 1 presents that the brush driving gear and the brush driven gear are provided along a straight line. Alternatively, the brush driving gear and the brush driven gear may be spaced apart a predetermined distance with respect to an inserting direction of the filter assembly in a predetermined range of angles.

For instance, the shaft 691 of the brush motor 69 and the brush shaft 675 may not be located on a straight line.

The filter assembly 6 is inserted in the discharge duct 41 via the suction hole 411. At this time, if the brush driven gear 679 and the brush driving gear 693 are located on a straight line, teeth of the brush driving gear 693 might fail to engage with teeth of the brush driven gear 679 precisely.

If the filter assembly is inserted in the discharge duct even with the teeth of the brush driving gear not engaged with the teeth of the brush driven gear precisely, the teeth may be damaged and the structure described above can reduce this damage problem.

The foreign substance removal unit is rotated in a reciprocating manner along a clockwise/counter-clockwise direction within a predetermined range of angles. Because of that, the brush 671 moves the foreign substances remaining in the filter unit 65 to a storage space 7 locate in the housing, with being rotated in a reciprocating manner within the housing.

When the brush 671 is rotated in a reciprocating manner within the predetermined range of angles, the foreign substances remaining in the filter unit 65 may be compressed in the storage space 7 provided in the housing.

For example, when the angle range of the reciprocating rotational movement of the brush 671 is set to be overlapped with a storage area of the storage space 7, the brush may not only move the foreign substances remaining in the filter unit to the storage space but also compress them in the storage space 7.

Figure 3:
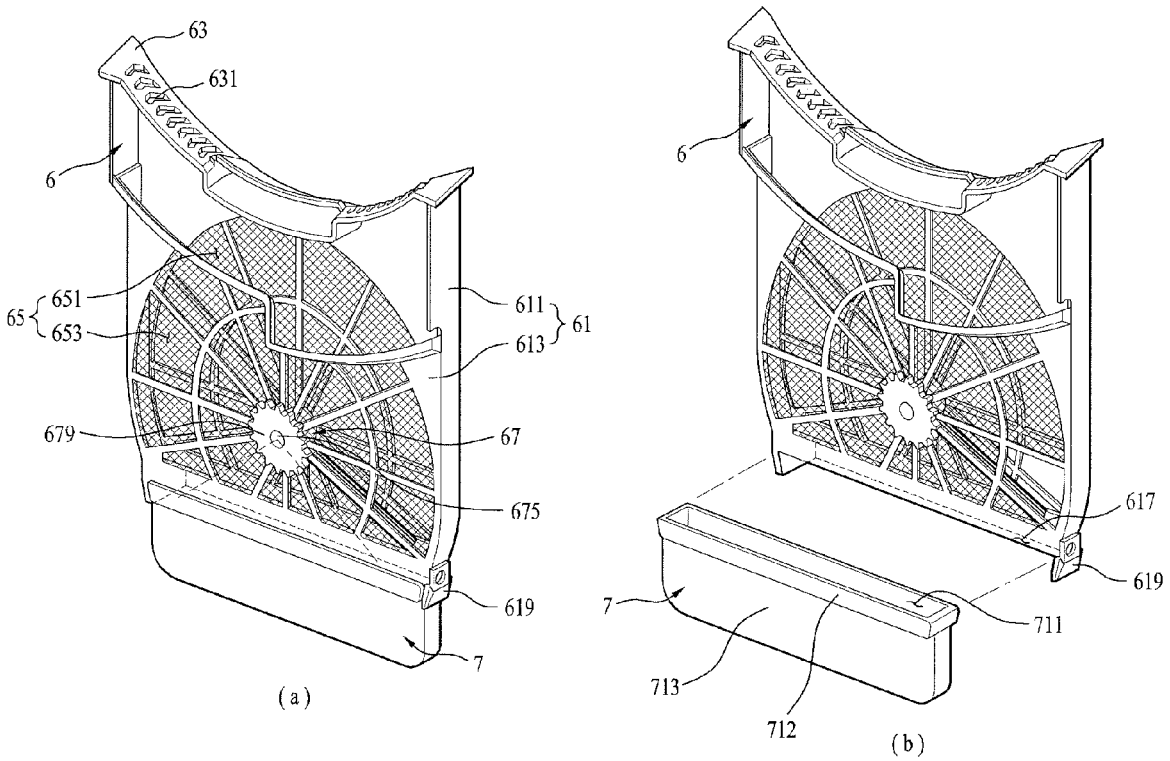
FIGS. 3A and 3B illustrate a filter assembly according to another implementation of the clothes treatment apparatus.

FIG. 3 illustrates a detachable structure of the storage space 7 from the filter assembly 6. In this case, a communication hole 617 in communication with the storage space 7 and an attaching/detaching part 619 having the storage space 7 coupled thereto may be further provided in the housing 61 of the filter assembly.

Here, the storage space 7 further includes a connection part 712 that couples to the attaching/detaching part 619 and a storage part 713 provided under the connection part 712 to store the foreign substances therein.

The connection part 712 includes an opening 711 in communication with the communication hole 617.

The reciprocating rotation angle range of the brush 671 is set to be overlapped with a rotational area of the brush and a storage area of the storage part.

Figure 6:
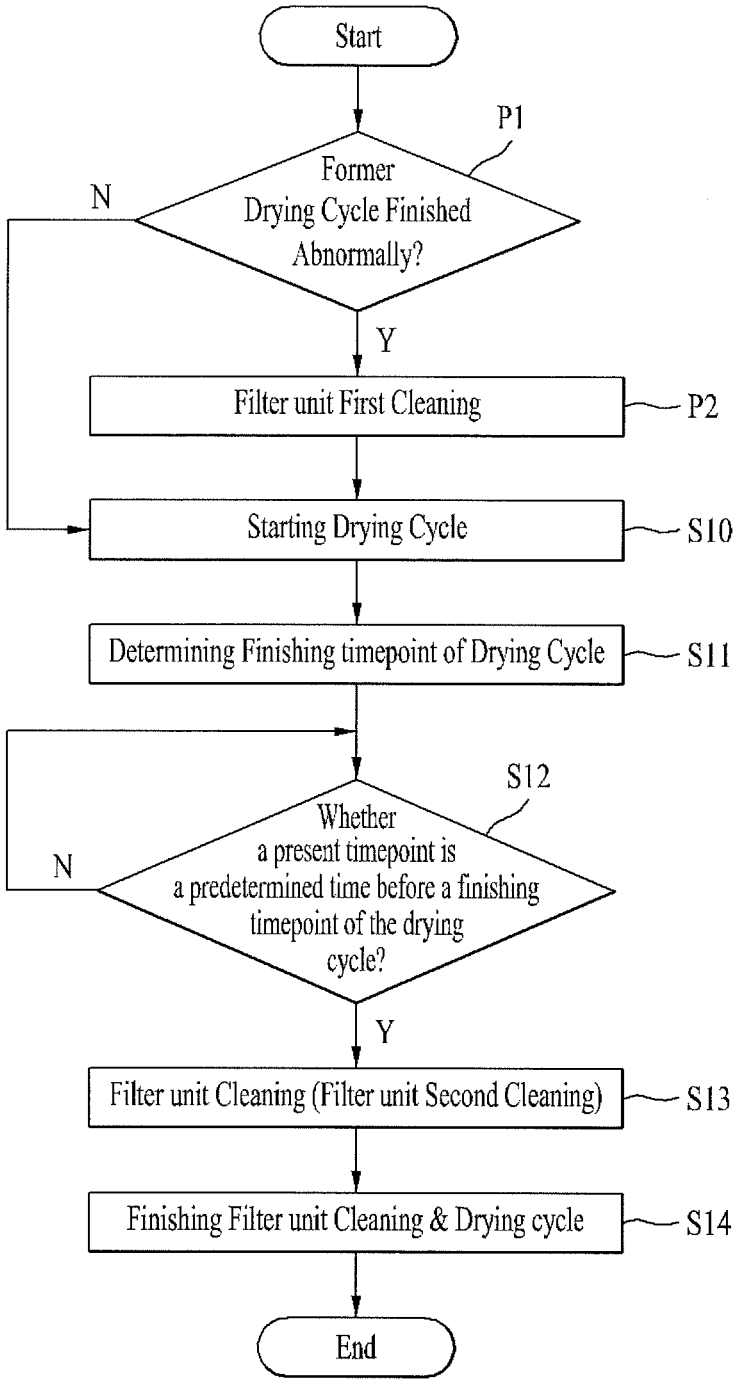
FIGS. 6 to 11 are flow charts illustrating control methods according to the present disclosure.

FIG. 6 illustrates an example control method for the clothes treatment apparatus described above. Here, the clothes treatment apparatus having the above structure is an example for performing this control method which will be described as follows. An object of the control method according to the present disclosure may not be limited to the clothes treatment apparatus including all of the components described above.

For example, the control object of the present disclosure may be any clothes treatment apparatuses, such as clothes treatment apparatuses with the accommodating space configured to receive clothes therein, the air supply unit configured to supply air (heated air or not-heated air) to the accommodating space, the filter unit configured to filter foreign substances from air exhausted from the accommodating space and the foreign substance removal unit configured to remove the foreign substances remaining in the filter unit.

Here, the foreign substance removal unit may have the structure enabling the foreign substance removal unit to remove the foreign substances of the filter unit by rotating in a reciprocating manner along the inside of the housing, rather than the structure of rotation with respect to the filter unit.

The control method for the clothes treatment apparatus according to the present disclosure includes a cycle starting step (S10) configured to start a drying cycle and a filter unit cleaning step (S13) performed at least one time before the drying cycle is terminated.

The drying cycle is a cycle for drying the clothes stored in the accommodating space by using air supplied to the accommodating space 2. The filter unit cleaning step includes removing of the foreign substances remaining in the filter unit 65 by using the foreign substance removal unit 67.

The drying cycle may be configured to supply air to the accommodating space and to rotate the drum 21 at the same time.

The filter unit cleaning step (S13) is provided between a starting time point (e.g., a specified instance or a point in time) and a finishing time point of the drying cycle. This is because it is desirable to remove the foreign substances remaining on the filter unit whenever the clothes treatment apparatus 100 is put into the operation, to improve drying efficiency of the clothes treatment apparatus and to reduce inconvenience that the user has to remove the foreign substances whenever the clothes treatment apparatus is used.

In addition, the filter unit cleaning step (S13) may be provided to start a predetermined time point before the drying cycle finishes. For that, the control method according to the present disclosure may further include a finishing time point determining step (S11) configured to determine a finishing time point of the drying cycle after the cycle starting step (S10).

In this case, the control method according to the present disclosure periodically identifies whether a present time point is a predetermined time point before a finishing time point of the drying cycle (S12), and it performs the filter unit cleaning step (S13) when the present time point reaches a preset point.

After that, the filter unit cleaning step may finish (S14) when the drying cycle is terminated.

Here, the filter unit cleaning step may finish before the drying cycle finishing step or after the drying cycle finishing step, based on a preset time period (e.g., an amount of time) of the filter unit cleaning step.

In case the filter unit cleaning step finishes before the drying cycle finishes, the time period between the filter unit finish time point and the drying cycle finish time point may be set as a time period remaining only a small quantity of foreign substances. If so, it is unnecessary to clean the filter unit when the clothes treatment apparatus is used next time (e.g., when the next drying cycle starts).

In addition, the control method according to the present disclosure identifies whether a former drying cycle (e.g., a drying cycle which is performed before the present drying cycle) finishes abnormally (P1) and it may further include a filter unit first cleaning step (P2) based on the result of the identification step.

'Abnormal finish (termination) of the former drying cycle' may occur when the former drying cycle finishes without performing the filter unit cleaning step (S13, referenced to as 'filter unit second cleaning step' for explanation convenience).

That is, the filter unit second cleaning step (S13) is not performed as the drying cycle is forced to finish by the user's selection or it is not performed as the drying cycle finishes because of the other reasons, for example, power outage and the like.

To identify whether the former drying cycle finishes abnormally or not (P1), a control unit provided in the clothes treatment apparatus stores implementation records of the filter unit second cleaning step (S13) whenever the filter unit second cleaning step is finished.

In this case, the step of identifying whether the former drying cycle is terminated abnormally or not (P1) checks the implementation records of the filter unit second cleaning step stored in the control unit, when the power is input to the clothes treatment apparatus.

If two or more times performance of the filter unit second cleaning step is set in the drying cycle, the identification step (P1) may identify whether all of the filter unit second cleaning steps set in the former drying cycle are implemented.

In this case, the filter unit first cleaning step (P2) may not be performed when all the filter unit second cleaning step set in the former drying cycle are implemented.

The control method according to the present disclosure may start the filter unit cleaning step (S13) at a time point of a predetermined time point after the drying cycle starts, not at the time point of the predetermined time point before the drying cycle finishes.

In this case, the control method according to the present disclosure requires a step of identifying whether a predetermined time period passes after starting the drying cycle, instead of determining the finishing time point of drying cycle (S11) and the identifying the present time point (S12).

Figure 7:
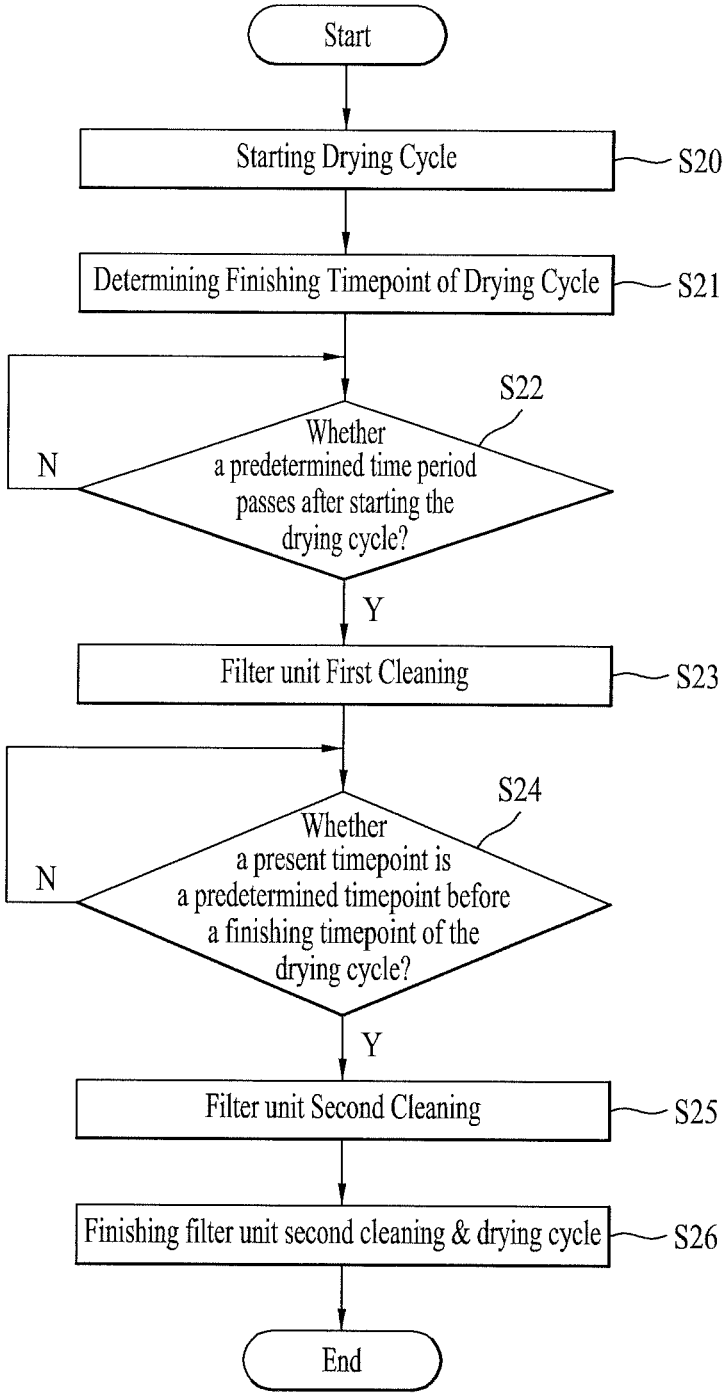

FIG. 7 illustrates another implementation of the control method according to the present disclosure. This implementation presents that at least two of the filter unit cleaning steps are implemented between the starting time point and the finishing time point of the drying cycle.

For example, the control method according to this implementation may include a step of starting drying cycle (S20), a step of determining a finishing time point of the drying cycle (S21), a step for identifying whether a predetermined time period passes after the drying cycle starting time point (S22), a filter unit first cleaning step (S23), a step for identifying whether a present time point is a cleaning start time point located a predetermined time before the finishing time point of the drying cycle (S24), and a filter unit second cleaning step (S25) for cleaning the filter unit when the present time point is the cleaning start time point. After filter unit second cleaning step (S25), the filter unit cleaning step may finish (S26) when the drying cycle is terminated.

Characteristics and effects of the steps may be similar to the characteristics and effects of the steps described above according to the above implementation in reference to FIG. 6 and detailed description thereof will be repeated.

In addition, although not shown in FIG. 7, there may be further provided the step of identifying whether a former drying cycle is terminated abnormally or not, and the filter unit cleaning step performed based on the result of the identification step, before the drying cycle starting step (S20).

Figure 8:
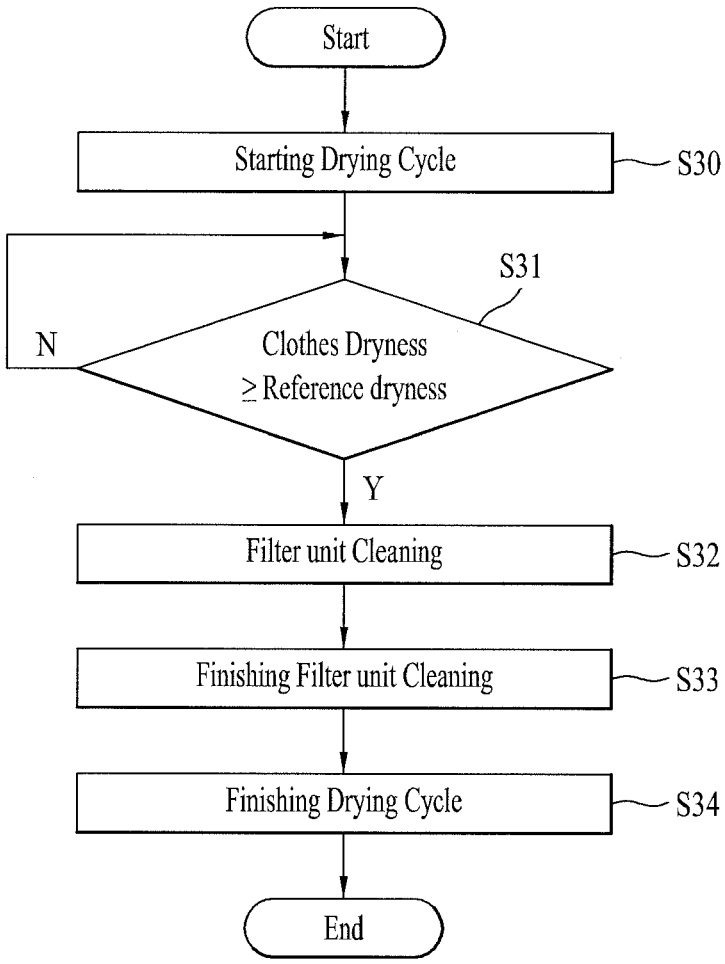

According to FIG. 8, the starting time point of the filter unit cleaning step is determined by a dryness level of the clothes received in the accommodating space.

The control method for the clothes treatment apparatus according to this implementation has a characteristic of a step for identifying whether the dryness of the clothes accommodated in the accommodating space is a predetermined dryness or more (S31), which is performed after a step of starting drying cycle (S30).

When the dryness (or dryness level) of the clothes is a reference dryness (or dryness level) or more, the filter unit cleaning step (S32) is started. After filter unit cleaning step (S32), the filter unit cleaning step may finish (S33) and the drying cycle may finish (S34).

Further, the dryness of the clothes accommodated in the accommodating space may be measured by a dryness measuring unit provided in the clothes treatment apparatus 100.

The dryness measuring unit may be a humidity measuring device (S, see FIG. 1) configured to measure a humidity of air exhausted from the accommodating space.

Figure 12:
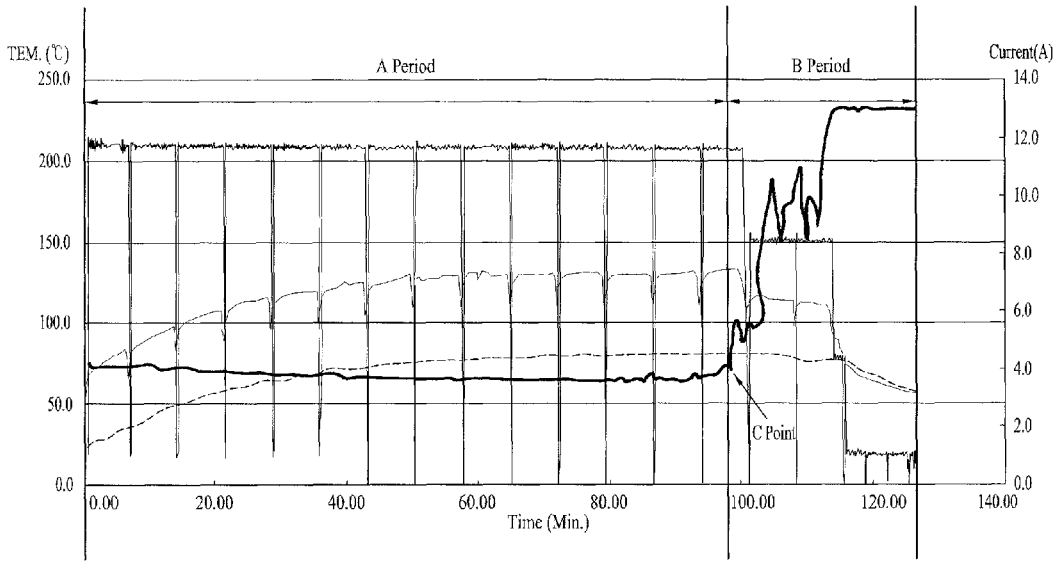
FIG. 12 is a graph illustrating humidity change of air exhausted from the accommodating space during a drying cycle.

FIG. 12 is a graph of humidity change with respect to the air exhausted from the accommodating space during the drying cycle (e.g., a graph of current values converted from the humidity of the air exhausted from the accommodating space by the humidity measuring device).

A heat exchange rate is relatively low in an initial period of the drying cycle, even when heated air is supplied to the accommodating space 2 by the air supply unit 5. Because of that, there may be little change in the humidity of the air exhausted from the accommodating space ('A' period).

As the clothes are wet in the initial period of the drying cycle, it is not easy to exchange heat between the heated air and the clothes even when the heated air is drawn into the accommodating space continuously.

However, a humidity value of the air exhausted from the accommodating space is increasing as the drying cycle is performed and the increasing humidity value is changing drastically when the drying cycle reaches a specific time point (C).

Here, the air exhausted outside the accommodating space after heat-exchanged with the clothes may include foreign substances such as lint. The quantity of the foreign substances exhausted from the accommodating space may be increasing as the dryness of the clothes is getting high.

As a result, less foreign substances are discharged outside the accommodating space in 'A' period and more foreign substances are discharged in 'B' period where the heat exchange between the clothes and the heated air is performed actively.

An implementation shown in FIG. 8 has a main characteristic that drying efficiency is reduced from deteriorating by cleaning of the filter unit in the period where a lot of the foreign substances are discharged from the accommodating space.

There may be provided a step of comparing a dryness level of the clothes with a reference dryness level (S31). In the step of comparing the dryness level of the clothes with the reference dryness level (S31), humidity data (e.g., current values corresponding to the humidity) measured from the air exhausted from the accommodating space by the humidity measuring device (S) and the measured humidity date is compared with reference humidity date by the control unit. Alternatively, a rate of the humidity variation for the air exhausted from the accommodating space may be compared with the reference rate of the humidity variation.

In the former case, the reference humidity data may be stored in the control unit as a type of data which can be directly compared with the humidity data measured by the humidity measuring device. The control unit compares the reference humidity data with the measured humidity data and it may determine whether the filter unit cleaning time point is reached based on the result of the comparison.

The reference humidity data may be set to be humidity data measured at a time point when a rate of water content possessed by the clothes (e.g., the water weight/(the clothes weight+the water weight)) is 30%-40%.

The reference humidity data may be set to be humidity data measured at a time point when 50% of the drying time period is passed.

Those indexes are corresponding to 'C' point shown in FIG. 12.

When the filter unit cleaning point is determined based on the result of the comparison between the variation rate of the humidity and the reference variation rate of the humidity, it is used that a variation rate of the humidity data is drastically changing at 'C' point in the drying cycle, as identified in FIG. 12.

That is, the control unit receives the humidity data measured by the humidity measuring device and computes the variation rate of the humidity per unit time. After that, the control unit compared the calculated variation rate with the reference variation rate and it determines the filter unit cleaning time point based on the result of the comparison (e.g., it is used that the variation rate of the humidity at 'A' period is close to 'zero' and the variation rate of the humidity is a positive value (+) for a predetermined time period at 'C' point).

The dryness determining step (S31) for the clothes accommodated in the accommodating space may be performed based on the result of comparison between a rate of water content possessed by the clothes and a reference rate of water content.

For example, a measuring device configured to measure the rate of water content possessed by the clothes is provided in the clothes treatment apparatus 100 and the measuring device measures the rate of water content possessed by the clothes inside the accommodating space periodically. The measured rate of water content is compared with the reference rate of water content (approximately 30%~40%) and the dryness determining step may be performed based on the result of the comparison.

The measuring device to measure the rate of water content may be an electrode sensor provided in the accommodating space.

That is, when a pair of electrodes provided in the electrode sensor is configured to contact with the clothes during the rotation of the drum, the control unit can compare current values or voltage values sensed by the pair of the electrodes with a reference value preset according to the rate of water content. Then the control unit can determine the rate of water content contained in the clothes.

Alternatively, the dryness identifying step for the clothes accommodated in the accommodating space (S31) may be performed by identifying whether the temperature of air exhausted from the accommodating space is a reference temperature or more.

The dryness level is getting high as getting close to the finishing time point of the drying cycle. When the dryness level is getting high, the air supplied by the air supply unit is exhausted to the discharge duct with little heat exchange with the clothes inside the accommodating space. Because of that, the dryness of the clothes can be determined by measuring the temperature of the air exhausted from the accommodating space.

As a result, if a temperature measuring unit for measuring the temperature of the air exhausted from the accommodating space is provided in the clothes treatment apparatus and the control unit provided to compare data measured by the temperature measuring unit with a reference value, the dryness determining step may be performed by using the temperature measuring unit.

Figure 9:
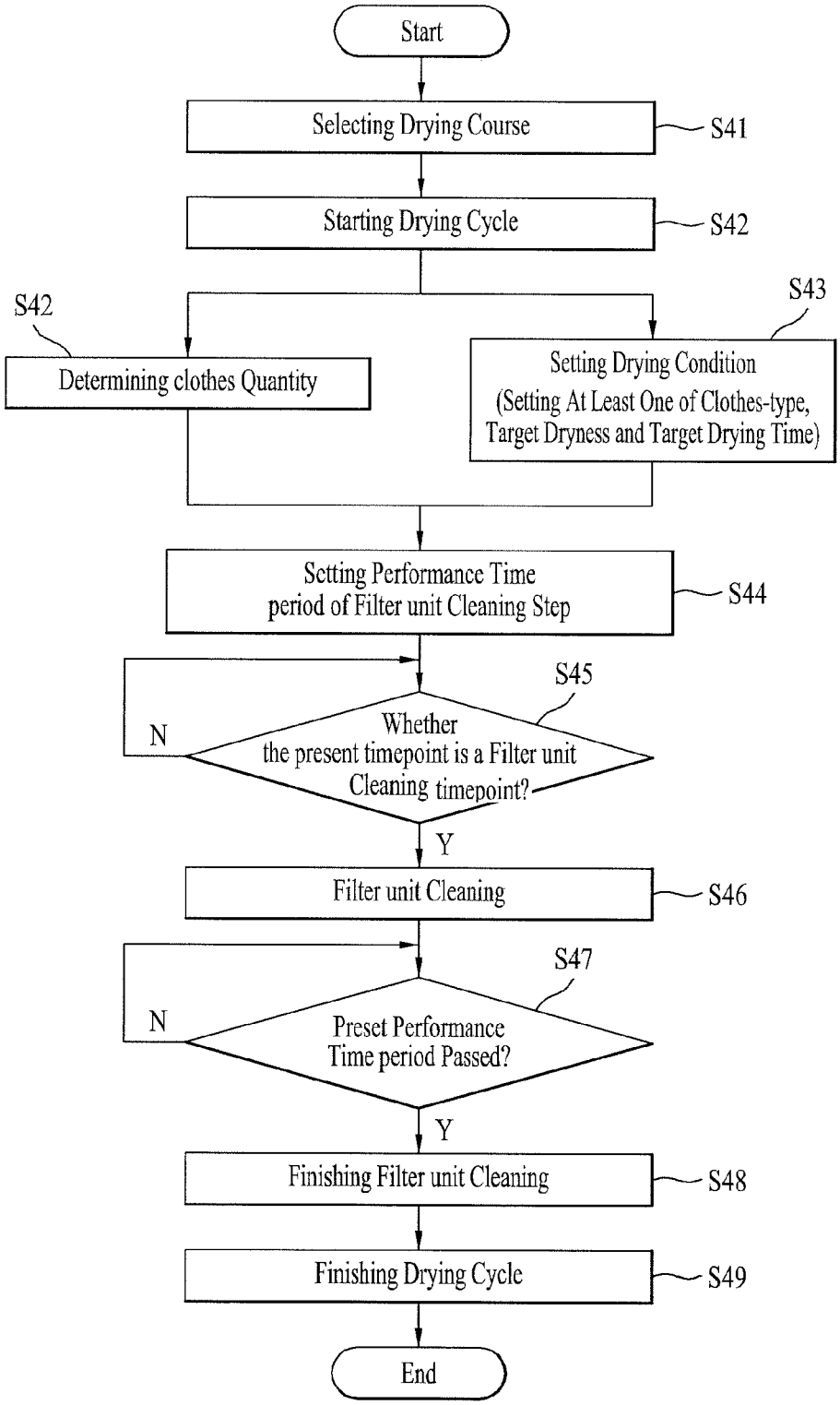

FIG. 9 illustrates an example control method for setting the performance time of the filter unit cleaning step (S13, S25 and S32) described above based on at least one of the quantity of the clothes loaded into the accommodating space (e.g., clothes quantity), the type of the clothes (e.g., the clothes type), a target dryness set in the drying cycle, and a target drying time set in the drying cycle.

For instance, the filter unit cleaning step (S46) according to this implementation is performed before the finishing time point of the drying cycle, and the performance time period of the filter unit cleaning step according to this implementation is set (S44) based on at least one of the quantity of the clothes, the type of the clothes, the target dryness set in the drying cycle, and the target drying time set in the drying cycle.

First of all, the characteristic of the performance time period of the filter unit cleaning step set based on the quantity of the clothes will be described. This characteristic is considering the quantity of the foreign substances exhausted from the accommodating space during the drying cycle may be increasing, as the quantity of the clothes received in the accommodating space is getting large.

For that, the control method according to this implementation further includes a clothes quantity determining step (S42) and a performance time period setting step (S44) for the filter unit cleaning step (S46), which are provided before the performance of the filter unit cleaning step (S46).

When clothes a quantity sensing device provided in the clothes treatment apparatus transmits clothes quantity data to the control unit, the clothes quantity determining step (S42) compares the transmitted clothes quantity data with a reference value and it determines the quantity of the clothes stored in the accommodating space or a clothes quantity level (e.g., data of a period having the highest value and the lowest value of the clothes quantity data).

The clothes quantity sensing device may be various types, for example, a device for sensing the quantity of the clothes accommodated in the accommodating space based on a rotation load of the drum motor 213, a device contactable with the clothes accommodated in the accommodating space to determine the quantity of the clothes based on a contact frequency of the clothes, and the like.

The performance time period setting step (S44) of the filter unit cleaning step may select a performance time period corresponding to the clothes quantity measured by the control unit from a performance time period data table preset based on the clothes quantity.

In this case, the performance time period data table may be a data table where performance time periods for corresponding quantities of clothes are stored. Experimental data having longer performance time periods if the clothes quantity is getting larger and short performance time periods if the clothes quantity is getting smaller.

When the performance time period of the filter unit cleaning step is set based on the quantity of the clothes, the control method according to this implementation determines whether the filter unit cleaning time point is reached (S45).

The step for determining whether the present time point is the filter unit cleaning time point (S45) may be performed by determining whether the present time point is the predetermined time point before the finishing time point of the drying cycle, whether the present time point is the predetermined time point after the starting time point of the drying cycle or whether the dryness level is the reference dryness level or more.

When it is determined that the present time point is the filter unit cleaning time point, the control unit operates the foreign substance removal unit for the performance time period set in the performance time period setting step (S44) and the foreign substance removal unit removes the foreign substances remaining in the filter unit (S46).

Also, the quantity of the foreign substances exhausted from the accommodating space may be differentiated based on drying conditions such as type of clothes (a type of clothes), a target dryness and a drying time (a target drying time), besides the quantity of the clothes.

For example, clothes may include a variety of types of clothes including cotton clothes, synthetic fabric clothes, sensitive fabric clothes fragile to heat such as lingerie, woolen clothes and functional clothes such as sportswear.

The quantity of the foreign substances such as lint exhausted during the drying cycle may be differentiated based on materials of the clothes. According to the result of experiments, it is shown that the largest quantity of the foreign substances may be exhausted from the cotton clothes.

The target dryness is a dried state of the clothes when the drying cycle finishes and may be one of the elements used to determine the quantity of the foreign substances exhausted from the accommodating space during the drying cycle.

Various levels of the target dryness may be set by a manufacturer of the clothes treatment apparatus, for example, strong, normal, and weak, for ironing and the like. Here, when the target dryness level is for ironing, the dryness having a predetermined amount of water (or moisture) remaining in the clothes for ironing, after the drying cycle finishes.

When the target dryness is 'strong' level, the rate of water content possessed by the clothes may be the lowest at the end point of the drying cycle. When the target dryness is 'for ironing' level, the rate of water content may be the highest at the end point of the drying cycle.

As described above, the quantity of the foreign substances exhausted from the accommodating space is increasing as it passes later in the drying cycle. This indicates that the quantity of the foreign substances is increasing as the rate of water content is getting lower.

Because of that, if the target dryness is considered in the performance time period of the filter unit cleaning step after the target dryness set in the drying cycle is determined, drying efficiency may be expected to be improved.

The drying time period set in the drying cycle (e.g., the target drying time period) may be one of the elements used to determine the quantity of the foreign substances exhausted from the accommodating space. If the target drying time period set in the drying cycle is long, the time period to exhaust the foreign substances may be relatively long.

Because of that, if the performance time period of the filter unit cleaning step is set based on the type of the clothes loaded into the accommodating space, the target dryness set in the drying cycle and the target drying time period, the drying efficiency may be expected to be improved.

To reflect at least one of the type of the clothes, the target dryness and the target drying time period in the performance time period of the filter unit cleaning step, the control method according to this implementation further includes a drying condition setting step (S43) for identifying a drying condition (e.g., the clothes type, the target dryness and/or the target drying time period).

In the drying condition setting step (S43), the user may directly input the drying condition via an input part provided in the clothes treatment apparatus.

That is, the drying condition setting step (S43) may include a clothes type inputting step, a target dryness inputting step and a target drying time period inputting step, which are performed before the performance time period setting step (S44).

Here, in case of reflecting some of the clothes type, the target dryness and the target drying time period in the performance time period of the filter unit cleaning step, a step for inputting a corresponding drying condition may be provided before the drying condition setting step (S43).

In addition, the drying condition setting step (S43) receives the drying conditions from a drying course selected by the user before the drying cycle starting step (S41).

The drying course is an implementing condition of the drying cycle. The temperature of air which will be supplied to the accommodating space during the drying cycle, the quantity of the air, and finishing conditions of the drying cycle are stored in the drying course. The user may select the drying course displayed on a display unit 11 to implement the drying cycle.

In addition, there may be stored in the drying course information on the quantity of clothes which are targets of a corresponding course, information on the type of the clothes (e.g., information on target clothes), information on a target dryness of the corresponding course and information on a target drying time period of the corresponding course.

As a result, the control method according to this implementation further include a drying course selecting step (S41) provided before the cycle starting step (S42). The drying condition setting step (S43) sets the target clothes, the target dryness and the target drying time period, which are stored in the drying course selected in the drying course selecting step, as the drying conditions.

Once the drying conditions are set in the steps described above, the performance time period of the filter unit cleaning step is set based on the drying conditions (S44). When the filter unit cleaning time point comes (S45) after that, the filter unit is cleaned (S46 and S48) for the time period (S47) set in the performance time period setting step (S44). After filter cleaning finishes (S48), the drying cycle may finish (S49).

Here, the performance time period setting step performed based on the quantity of the clothes as described above is explained separated from the performance time period setting step performed based on the drying condition. However, this implementation may present that the performance time period setting step (S44) is performed after the clothes quantity determining step (S42) and the drying condition setting step (S43) are performed (the data setting step, S42+S43).

If at least two or more of the clothes quantity, the clothes type, the target dryness and the target drying time period are reflected in the performance time period of the filter unit cleaning step, the performance time period setting step (S44) may set the sum of values gained from multiplying each of reference time periods set in corresponding conditions by each of weight set in corresponding conditions, as the filter unit cleaning time period.

To embody this characteristic, a storage device or the control unit provided in the clothes treatment apparatus may include a plurality of reference time period data (for example, 10, 20 and 30 sec., see FIG. 13) set based on quantities of clothes (A1, A2 and A3, see FIG. 13), a plurality of reference time period data (for example, 10, 30 and 50 sec.) set based on types of clothes classified based on quantities of generated lint (B1, B2 and B3), a plurality of reference time period data (for example, 10, 15 and 20 sec.) set based on target dryness levels (C1, C2 and C3) and a plurality of reference time period data (for example, 5, 10 and 15 sec.) set based on target drying time periods (D1, D2 and D3).

In addition, the control unit or the storage device may include a clothes-quantity weight (w), a clothes-type weight (x), a dryness level weight (y) and a drying time period weight (z) which are set based on the extent to which the clothes quantity, the clothe type, the target dryness and the target drying time period affect the quantity of the foreign substances exhausted from the accommodating space.

In case of setting the performance time period of the filter unit cleaning step based on the clothes quantity and the clothes type, the performance time period setting step (S44) sets the cleaning time period as the sum of a value gained from multiplying the reference time period data set based on the clothes quantity by the clothes-quantity weight and a value gained from multiplying the reference time period data set based on the clothes type by the clothes-type weight.

In case of setting the performance time period of the filter unit cleaning step (S46) based on all of the clothes quantity, the clothes type, the target dryness and the target drying time period, the performance time period setting step (S44) sets the performance time period of the filter unit cleaning step as the sum of a value gained from multiplying the reference time period data set based on the clothes quantity by the clothes-quantity weight, a value gained from multiplying the reference time period data set based on the type of the clothes by the clothes-type weight, a value from multiplying the reference time period data set based on the target dryness by the dryness weight and a value gained from multiplying the reference time period data set based on the target drying time period by the drying time period weight.

Figure 10:
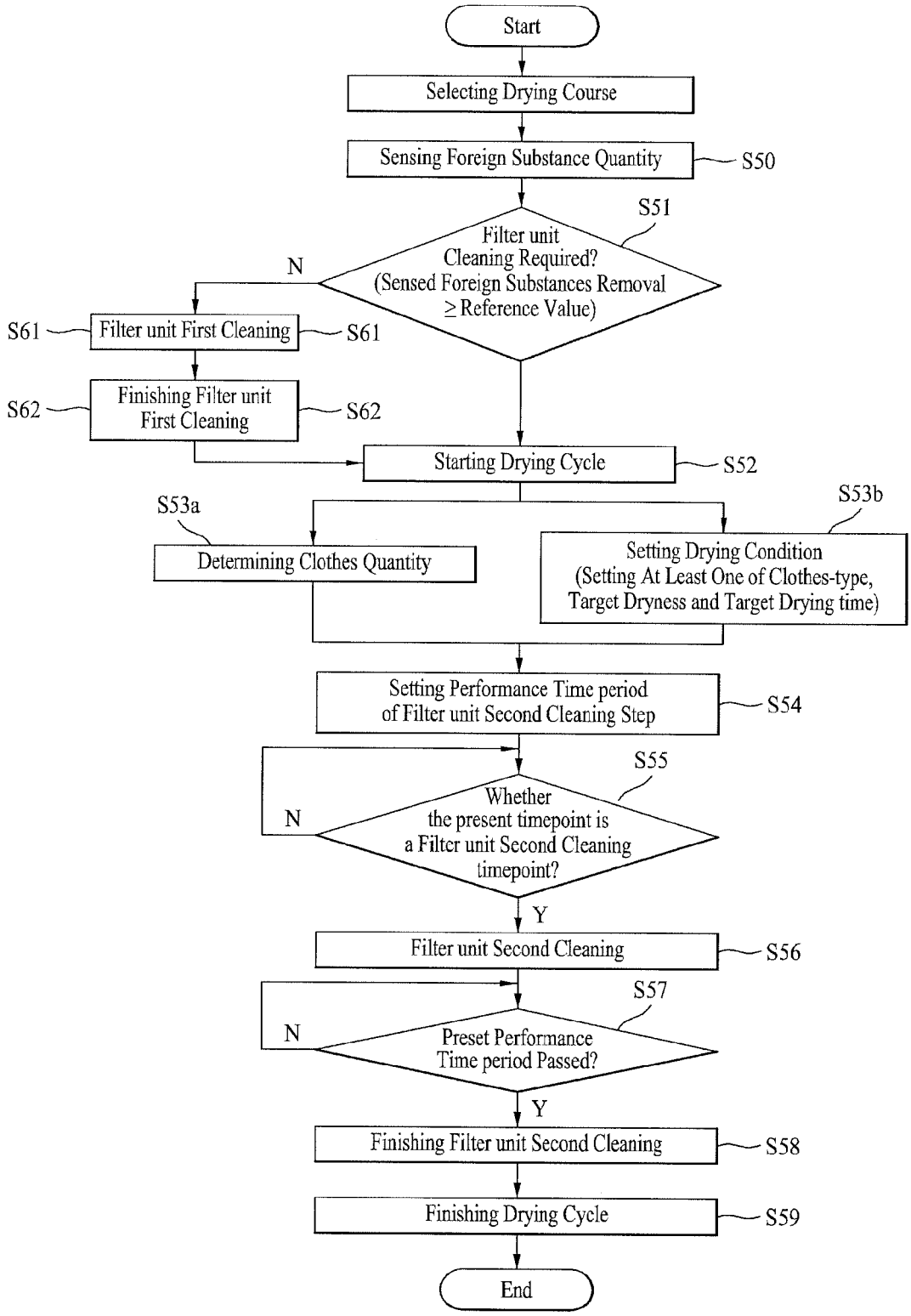

FIG. 10 shows a characteristic that before starting the drying cycle (S52), the control method described above identifies whether cleaning of the filter unit is required or not (S51), although the foreign substances of the filter unit are removed whenever the clothes treatment apparatus 100 is put into operation.

For instance, a control method for the clothes treatment apparatus according to this implementation includes a step for sensing the quantity of the foreign substances remaining in the filter unit (S50), before the drying cycle starting step (S52).

The quantity of the foreign substances remaining in the filter unit 65 may be determined by a variety of devices and the devices may include an air quantity sensing device, an optical sensor, or a temperature sensing device provided in the clothes treatment apparatus 100.

If foreign substances remain in the filter unit, the quantity of air moving along the duct 4 will decrease. Because of that, the step for sensing the quantity of the foreign substances remaining in the filter unit (S50) may compare the quantity of the air measured by the air quantity sensing device with a preset reference quantity (S51), before the drying cycle starting step (S52).

Here, in case of sensing the foreign substance quantity sensing step (S50) by using the air quantity sensing device, it is unnecessary to supply the heated air, different from the drying cycle. Because of that, the air supply unit may be controlled to supply non-heated air in the foreign substances quantity sensing step.

If the quantity of the foreign substances remaining in the filter unit is large, the quantity of transmitted lights will be small. Because of that, a voltage value (or a current value) received by a light receiving part is compared with a reference value and the quantity of the foreign substances remaining in the filter unit may be then expectable. Here, the filter unit is located between the light receiving part and a light emitting part in opposite to the light receiving part.

If the quantity of the foreign substances remaining in the filter unit is large, it may be difficult to circulate the air inside the duct and the pressure or temperature inside the duct may increase. Because of that, when a pressure or temperature measured by pressure sensing device or temperature sensing device provided in the duct is compared with a reference pressure or a reference temperature, then the quantity of the foreign substances remaining in the filter unit may be determined.

When the quantity of the foreign substances measured by the devices described above is less than a reference value which is the quantity of the foreign substances requiring the filter unit cleaning (or a reference value or less), the drying cycle starts (S52). However, when the measured quantity of the foreign substances is the reference value or more (or more than the reference value), the control method according to this implementation performs a filter unit first cleaning step (S61) and the drying cycle starting step (S52) is performed after finishing the filter unit first cleaning step (S62).

The foreign substance quantity sensing step (S50), the filter unit first cleaning step (S61) of the control method according to this implementation may reduce deterioration of drying efficiency.

Once the drying cycle starts, a clothes quantity determining step (S53*a*), a drying condition setting step (S53*b*) and a filter unit second cleaning step performance time period setting step (S54) for setting a performance time period of a filter unit second cleaning time (S56) may be performed. The detailed description of each step is described above and the detailed description is not repeated.

After that, the control method according to this implementation determines whether the present time point is a filter unit second cleaning time point (S55) and it performs the filter unit second cleaning step (S56) for a time period (S57) set by the filter unit second cleaning performance time period setting step (S54), to finish the filter unit cleaning (S58) and the drying cycle (S59).

Figure 11:
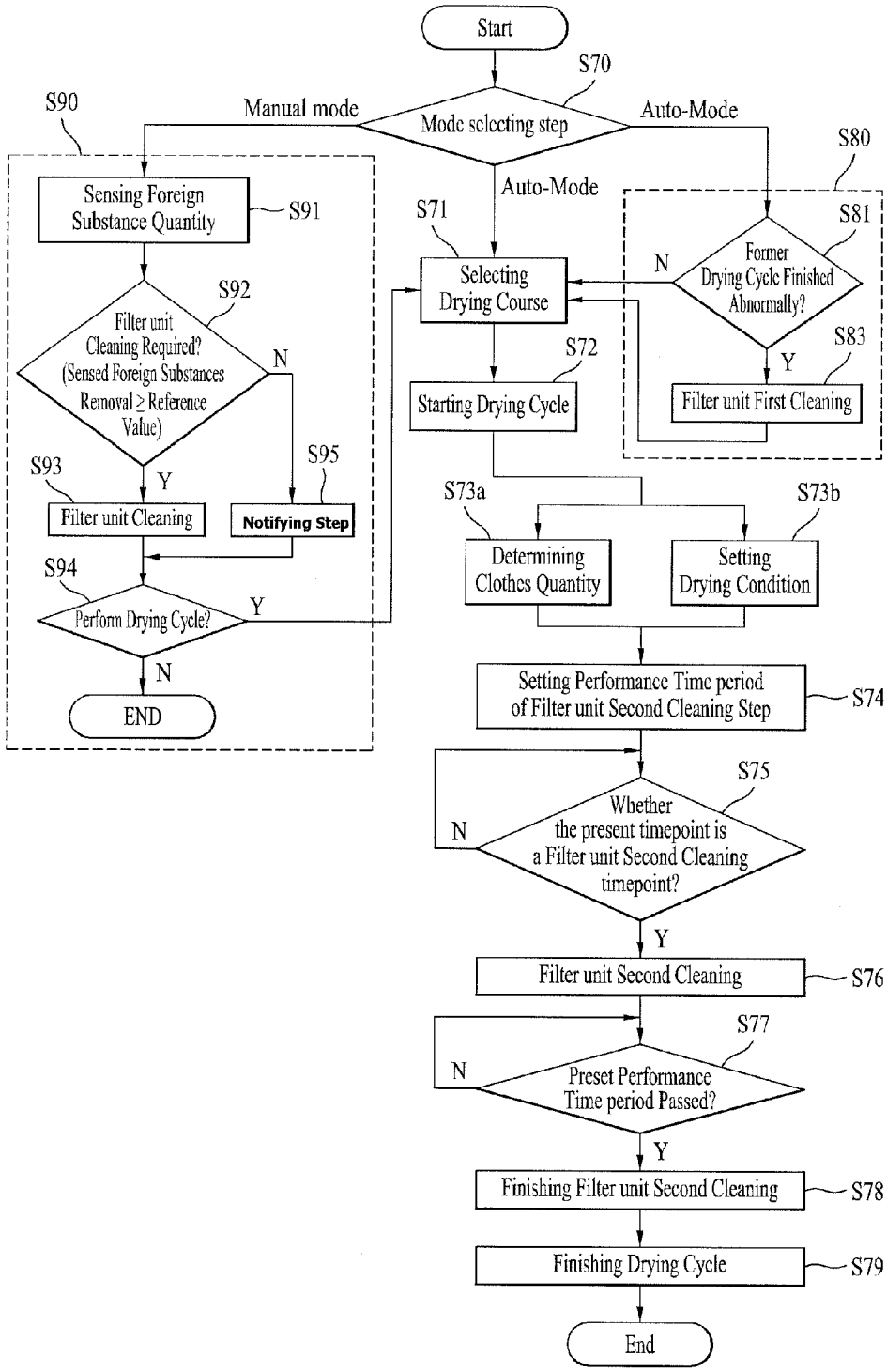

FIG. 11 illustrates an example control method for the clothes treatment apparatus according to another implementation of the present disclosure. According to this implementation, the clothes treatment apparatus is controlled differently based on an automatic mode (hereinafter, an auto-mode) and a manual mode (hereinafter, a manual-mode).

The auto-mode is a control mode configured to sequentially perform a filter unit cleaning step and a drying cycle. The manual-mode is a control mode configured only to clean the filter unit.

This implementation includes a step for identifying which one of the manual-mode (S90) and the auto-mode (S80) is selected (S70).

When the manual-mode is selected, the control method according to this implementation senses the quantity of the foreign substances remaining in the filter unit (S91) and it compares the measured quantity of the foreign substances with a preset reference quantity value (S92).

The step for sensing the quantity of the foreign substances remaining in the filter unit and for comparing the measured quantity with the reference value is identical to the description in referenced to FIG. 10 and detailed description thereof is not repeated.

When the quantity of the foreign substances remaining in the filter unit is the preset reference value or more, the control method according to this implementation performs a filter unit cleaning step (S93) for controlling the foreign substance removal unit to remove the foreign substances remaining in the filter unit. As a result, according to this implementation, the user can only clean the filter unit when he or she desires to, regardless of the drying cycle performance.

In addition, just in case the user desires to perform the drying cycle after cleaning the filter unit, the manual-mode (S90) may include a drying cycle performance identifying step (S94) for identifying whether to perform the drying cycle.

When the quantity of the foreign substances remaining in the filter unit is less than the reference value, the manual-mode (S90) performs a notifying step (S95) for displaying on the display part (11) provided in the clothes treatment apparatus that the filter unit cleaning step does not have to be performed. After that, the drying cycle performance identifying step (S94) can be performed.

When the auto-mode is selected in the mode selection identifying step (S70), the control method according to this implementation performs a filter unit first cleaning step (S83) before starting the drying cycle (S72).

The filter unit first cleaning step (S83) may be performed by identifying whether the former drying cycle finishes abnormally (S81) as shown in FIG. 11 or by whether the quantity of the foreign substances remaining in the filter unit is a reference value or more as shown in FIG. 10.

After that, the control method according to this implementation may perform a drying course selecting step (S71), a drying cycle starting step (S72), a clothes quantity determining step (S73*a*), a drying condition setting step (S73*b*) and a filter unit second cleaning step performance time period setting step (S74).

When a starting time point of the filter unit second cleaning step comes (e.g., a time point located at a predetermined time period after the drying cycle starts, a time point located at a predetermined time period before the drying cycle finishes and/or a time point located when dryness level is a reference dryness level or higher) (S75), the control method according to this implementation performs the filter unit second cleaning step (S76 and S78) for a predetermined performance time period (S77) and it finishes the drying cycle (S79) after that.

It will be apparent to those skilled in the art that various modifications and variations can be made in the present disclosure without departing from the spirit or scope of the disclosure. Thus, it is intended that the present disclosure covers the modifications and variations of this disclosure provided they come within the scope of the appended claims and their equivalents.

What is claimed is:

1. A method for controlling an apparatus for treating clothes that includes an accommodating space configured to accommodate clothes therein, an air supply unit configured to supply air to the accommodating space, a filter unit configured to filter foreign substances from air exhausted from the accommodating space and a foreign substance removal unit configured to remove the foreign substances remaining in the filter unit, the method comprising:

a cycle starting step configured to start a drying cycle supplying air to the accommodating space by controlling the air supply unit;

a determining step configured to determine a dryness of the clothes accommodated in the accommodating space by controlling a dryness measuring unit provided in the apparatus for treating clothes; and a filter unit cleaning step removing the foreign substances remaining in the filter unit by controlling the foreign substance removal unit, wherein the filter unit cleaning step is started based on the measured dryness being a preset reference dryness or higher.

2. The method of claim 1, wherein the filter unit cleaning step is performed before the drying cycle finishes.

3. The method of claim 1, further comprising:

a finishing time point determining step determining a finishing time point of the drying cycle, wherein the filter unit cleaning step is started at a time point located prior to a predetermined time period from the finishing time point of the drying cycle.

4. The method of claim 1, wherein the filter unit cleaning step is started at a time point located after a predetermined time period from a starting time point of the drying cycle.

5. The method of claim 4, further comprising:

a finishing time point determining step determining a finishing time point of the drying cycle; and a filter unit second cleaning step performed between a finishing time point of the filter unit cleaning step and the finishing time point of the drying cycle.

6. The method of claim 5, wherein the filter unit second cleaning step is started at a time point prior to a predetermined time period from the finishing time point of the drying cycle.

7. The method of claim 4, wherein the determining step configured to determine a dryness of the clothes comprises:

a drying time period determining step determining a drying time period required by the drying cycle, wherein the filter unit cleaning step is started based on 50% of the measured drying time period having passed.

8. The method of claim 1, further comprising:

a determining step determining whether a drying cycle performed before the cycle starting step finishes without performing the filter unit cleaning step; and a filter unit first cleaning step removing the foreign substances remaining in the filter unit, before the cycle starting step based on the drying cycle performed before the cycle starting step finishing without performing the filter unit cleaning step.

9. The method of claim 1, further comprising:

a determining step determining whether all of two or more filter unit cleaning step set in a drying cycle performed before the cycle starting step are implemented; and a filter unit first cleaning step removing the foreign substances remaining in the filter unit, before performing the cycle starting step based on all of two or more filter unit cleaning step set in the drying cycle performed before the cycle starting step not being implemented.

10. A method for controlling an apparatus for treating clothes that includes an accommodating space configured to accommodate clothes therein, an air supply unit configured to supply air to the accommodating space, a filter unit configured to filter foreign substances from air exhausted from the accommodating space and a foreign substance removal unit configured to remove the foreign substances remaining in the filter unit, the control method comprising:

a cycle starting step configured to start a drying cycle supplying air to the accommodating space by controlling the air supply unit;

a filter unit cleaning step removing the foreign substances remaining in the filter unit by controlling the foreign substance removing part; and a humidity variation rate measuring step measuring a variation rate of humidity of air exhausted from the accommodating space by humidity measuring means and a control unit configured to calculate data provided by the humidity measuring means, wherein the filter unit cleaning step is started when the measured variation rate of humidity is a preset reference value or more.

11. The method of claim 1, wherein the determining step configured to determine a dryness of the clothes comprises:

a humidity measuring step measuring a humidity of air exhausted from the accommodating space by controlling humidity measuring unit provided in the apparatus for treating clothes; and wherein the filter unit cleaning step is started based on the measured humidity being a preset reference humidity value or more.

12. The method of claim 1, wherein the determining step configured to determine a dryness of the clothes comprises:

a water content rate measuring step measuring a rate of water content possessed by the clothes accommodated in the accommodating space by controlling a water content rate measuring unit provided in the apparatus for treating clothes, wherein the filter unit cleaning step is started based on the measured rate of water content being a preset reference value or less.

13. The method of claim 1, further comprising:

a clothes quantity determining step determining the quantity of the clothes accommodated in the accommodating space by controlling a clothes quantity sensing unit provided in the apparatus for treating clothes, the clothes quantity determining step provided before the filter unit cleaning step; and a time period setting step setting a performance time period of the filter unit cleaning step in proportion to the determined quantity of the clothes, wherein the filter unit cleaning step is performed for the set performance time period.

14. The method of claim 1, further comprising:

a drying condition determining step determining a drying condition set in the drying cycle, the drying condition determining step provided before the filter unit cleaning step; and a time period setting step setting a performance time period of the filter unit cleaning step based on the determined drying condition, wherein the filter unit cleaning step is performed for the set performance time period.

15. The method of claim 14, wherein the drying condition comprises at least one of a type of clothes, a target dryness set in the drying cycle and a target drying time period set in the drying cycle.

16. The method of claim 14, wherein the drying condition determining step comprises a clothes type determining step determining the type of the clothes accommodated in the accommodating space, and the time period setting step sets the performance time period of the filter unit cleaning step in proportion to a generating quantity of lint of the determined clothes type.

17. The method of claim 16, further comprising:

a clothes type inputting step inputting the type of the clothes by controlling an input part provided in the apparatus for treating clothes, wherein the clothes type determining step determines the type of clothes accommodated in the accommodating space to be the type of the clothes input in the clothes type inputting step.

18. The method of claim 14, wherein the drying condition determining step comprises a target dryness determining step determining a target dryness of the drying cycle, and the time period setting step sets the performance time period of the filter unit cleaning step in proportion to the determined target dryness.

19. The method of claim 18, further comprising:

a dryness inputting step inputting a target dryness of the drying cycle by controlling an input part provided in the apparatus for treating clothes, wherein the target dryness determining step determines dryness input in the dryness inputting step to be the target dryness.

20. The method of claim 14, wherein the drying condition determining step comprises a target drying time period determining step determining a target drying time period set in the drying cycle, and the time period setting step sets the performance time period of the filter unit cleaning step in proportion to the determined target drying time period.

21. The method of claim 20, further comprising:

a drying time period inputting step inputting a drying performance time period of the drying cycle by controlling an input part provided in the apparatus for treating clothes, wherein the target drying time period determining step determines the drying performance time period input in the drying time period inputting step to be the target drying time period.

22. The method of one of claim 16, further comprising:

a drying course selecting step selecting a drying course storing information on at least one of target clothes of the drying cycle, a target dryness of the drying cycle and a target drying time period of the drying cycle, the drying course selecting step provided before the drying cycle starting step, wherein the clothes type determining step, the target dryness determining step and the target drying time period determining step determine target clothes information, target dryness information and target drying time information stored in the selected drying course to be the type of the clothes accommodated in the accommodating space, the target dryness and the target drying time period.

23. The method of claim 1, further comprising:

a data setting step setting at least two of a quantity of the clothes accommodated in the accommodating space, a type of the clothes accommodated in the accommodating space, a target dryness set in the drying cycle and a target drying time period set in the drying cycle, the data setting step provided before the filter unit cleaning step; and a time period setting step setting a performance time period of the filter unit cleaning step as a sum of values gained from multiplying each of filter unit cleaning time periods set based on the quantity of the clothes, the type of the clothes, the target dryness and the target drying time period by each of weights set based on the quantity of the clothes, the type of the clothes, the target dryness and the target drying time period, wherein the filter unit cleaning step is performed for the set performance time period.

24. The method of claim 23, wherein the data setting step comprises a clothes quantity determining step determining the quantity of the clothes accommodated in the accommodating space by controlling a clothes quantity sensing unit provided in the apparatus for treating clothes and a clothes type determining step determining the type of the clothes, wherein the time period setting step sets the performance time period of the filter unit cleaning step as the sum of a value gained from multiplying a filter unit cleaning time period preset based on the quantity of the clothes by a clothes-quantity weight and a value gained from multiplying a filter unit cleaning time period preset based on the type of the clothes by a clothes-type weight.

25. The method of claim 24, wherein the data setting step further comprises a target dryness determining step determining a target dryness of the drying cycle, and the time period setting step sets the performance time period of the filter unit cleaning step as the sum of a value gained from multiplying a filter unit cleaning time period preset based on the quantity of the clothes by a clothes-quantity weight, a value gained from multiplying a filter unit cleaning time period preset based on the type of the clothes by a clothes-type weight and a value gained from multiplying a filter unit cleaning time period preset based on the target dryness by a dryness weight.

26. The method of claim 25, wherein the data setting step further comprises a target drying time period determining step determining a target drying time period set in the drying cycle, and the time period setting step sets the performance time period of the filter unit cleaning step as the sum of a value gained from multiplying a filter unit cleaning time period preset based on the quantity of the clothes by a clothes-quantity weight, a value gained from multiplying a filter unit cleaning time period preset based on the type of the clothes by a clothes-type weight, a value gained from multiplying a filter unit cleaning time period preset based on the target dryness by a dryness weight and a value gained from multiplying a filter unit cleaning time period preset based on the target drying time period by a drying-time weight.

27. The method of claim 1, further comprising:

a determining step determining whether a quantity of the foreign substances remaining in the filter unit is a preset reference value or more, the determining step provided before the cycle starting step; and a filter unit first cleaning step removing the foreign substances remaining in the filter unit by controlling the foreign substance removal unit before the cycle starting step, based on the determined quantity of the foreign substances being the preset reference value or more.

28. The method of claim 1, further comprising:

a mode selecting step selecting a manual-mode and an auto-mode, wherein the cycle starting step and the filter unit cleaning step are performed sequentially, based on the auto-mode being selected and only the filter unit cleaning step being performed when the manual-mode is selected.

29. The method of claim 1, wherein the determining step configured to determine a dryness of the clothes comprises:

a temperature measuring step measuring a temperature of air exhausted from the accommodating space by a temperature measuring unit provided in the apparatus for treating clothes, wherein the filter unit cleaning step is started based on the measured temperature being a preset reference temperature value or more.

30. The method of claim 1, further comprising a determining step configured to determine whether a quantity of the foreign substances remaining in the filter unit is a preset reference value or more before the cycle starting step, wherein the determining step configured to determine whether a quantity of the foreign substances remaining in the filter is a preset reference value or more comprises:

measuring, by a light receiving part, an intensity of light emitted by a light emitting part, wherein the filter unit is located between the light emitting part and the light receiving part; and determining whether the measured intensity of light is less than a preset reference intensity.

31. The method of claim 1, further comprising a determining step configured to determine whether a quantity of the foreign substances remaining in the filter unit is a preset reference value or more, the determining step provided before the cycle starting step, wherein the determining step configured to determine whether a quantity of the foreign substances remaining in the filter is a preset reference value or more comprises:

measuring a flow rate of air passing through the filter unit by an air quantity sensing unit; and determining whether the measured flow rate of air is less than a preset reference flow rate of air.

32. The method of claim 1, further comprising a determining step configured to determine whether a quantity of the foreign substances remaining in the filter unit is a preset reference value or more, the determining step provided before the cycle starting step, wherein the determining step configured to determine whether a quantity of the foreign substances remaining in the filter is a preset reference value or more comprises:

measuring a temperature of air in a duct which is configured to provide a space for receiving the filter unit and communicate with the accommodating space; and determining whether the measured temperature of air in the duct is higher than a preset reference temperature.

* * * * *